US009085997B2

(12) United States Patent
Fujiyoshi et al.

(10) Patent No.: US 9,085,997 B2
(45) **Date of Patent: *Jul. 21, 2015**

(54) VALVE TIMING CONTROL APPARATUS

(71) Applicants: Toshiki Fujiyoshi, Okazaki (JP); Takashi Yamaguchi, Obu (JP)

(72) Inventors: Toshiki Fujiyoshi, Okazaki (JP); Takashi Yamaguchi, Obu (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/074,825

(22) Filed: Nov. 8, 2013

(65) Prior Publication Data

US 2014/0083383 A1 Mar. 27, 2014

Related U.S. Application Data

(62) Division of application No. 13/063,628, filed as application No. PCT/JP2009/004479 on Sep. 10, 2009, now Pat. No. 8,607,752.

(30) Foreign Application Priority Data

| | | |
|---|---|---|
| Sep. 11, 2008 | (JP) | 2008-233912 |
| Apr. 24, 2009 | (JP) | 2009-106873 |
| Aug. 24, 2009 | (JP) | 2009-193566 |

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34466* (2013.01); *F01L 2001/34469* (2013.01); *F01L 2001/34473* (2013.01); *F01L 2001/34483* (2013.01)

(58) Field of Classification Search
CPC ..... F01L 1/344; F01L 1/3442; F01L 2001/34466; F01L 2001/34469; F01L 2001/34473; F01L 2001/34483
USPC ..... 123/90.15, 90.17; 464/160
See application file for complete search history.

(56) References Cited

U.S. PATENT DOCUMENTS

| | | | |
|---|---|---|---|
| 5,738,056 | A | 4/1998 | Mikame et al. |
| 6,374,788 | B1 | 4/2002 | Fukuhara et al. |

(Continued)

FOREIGN PATENT DOCUMENTS

| | | |
|---|---|---|
| JP | 2001-041012 | 2/2001 |
| JP | 2006-037732 | 2/2006 |
| JP | 2008-227264 | 9/2008 |

OTHER PUBLICATIONS

International Search Report for PCT/JP2009/004479, mailed Dec. 8, 2009.

(Continued)

*Primary Examiner* — Ching Chang
(74) *Attorney, Agent, or Firm* — Nixon & Vanderhye P.C.

(57) ABSTRACT

A valve timing control apparatus has a regulation member to fix a phase. The regulation member has a main regulation member and a sub regulation member. The main regulation member is inserted into a recess part to regulate the phase. The sub regulation member has an engagement part engageable with the main regulation member in an escape direction Y and disengageable from the main regulation member in an insertion direction X. Further, the sub regulation member has a pressure reception part that receives pressure in the escape direction Y from hydraulic fluid in an operation chamber. The main regulation member is urged in the insertion direction X by a main resilient member. Further, the sub regulation member is urged in the insertion direction X by a sub resilient member. The main regulation member moves in the escape direction Y only by hydraulic fluid, and moves in the insertion direction X only by the resilient member.

3 Claims, 32 Drawing Sheets

(56) References Cited

U.S. PATENT DOCUMENTS

| | | | | |
|---|---|---|---|---|
| 6,378,477 | B1 | 4/2002 | Fukuhara et al. | |
| 6,382,156 | B1 | 5/2002 | Fukuhara et al. | |
| 6,460,496 | B2 | 10/2002 | Fukuhara et al. | |
| 6,745,735 | B2 | 6/2004 | Smith | |
| 6,779,499 | B2 | 8/2004 | Takenaka et al. | |
| 8,607,752 | B2 * | 12/2013 | Fujiyoshi et al. | 123/90.17 |
| 2002/0078913 | A1 | 6/2002 | Fukuhara et al. | |
| 2002/0139332 | A1 | 10/2002 | Takenaka | |
| 2003/0217717 | A1 | 11/2003 | Pierik et al. | |
| 2005/0016481 | A1 | 1/2005 | Komazawa et al. | |
| 2005/0051122 | A1 | 3/2005 | Hirowatari et al. | |
| 2005/0098131 | A1 | 5/2005 | Hirowatari et al. | |
| 2005/0132991 | A1 | 6/2005 | Knecht et al. | |
| 2005/0284432 | A1 | 12/2005 | Tsukada | |
| 2006/0266318 | A1 | 11/2006 | Suga et al. | |
| 2007/0056538 | A1 | 3/2007 | Simpson et al. | |
| 2007/0101962 | A1 | 5/2007 | Tsukada et al. | |
| 2009/0145386 | A1 | 6/2009 | Ushida | |

OTHER PUBLICATIONS

Translation of Written Opinion of the International Searching Authority for PCT/JP2009/004479, mailed Dec. 8, 2009.

Office Action (2 pages) dated May 28, 2013, issued in corresponding Japanese Application No. 2012-100367 and English translation (4 pages).

Office Action (1 page) dated Mar. 25, 2014, issued in corresponding Japanese Application No. 2013-153869 and English translation (2 pages).

* cited by examiner

VALVE TIMING CONTROL APPARATUS

CROSS REFERENCE OF THE RELATED APPLICATION

This application is a divisional of U.S. application Ser. No. 13/063,628, filed Mar. 11, 2011 which is the U.S. National Phase of International Application No. PCT/JP2009/004479 filed on Sep. 10, 2009, which designated the U.S. and is based upon and claims the benefit of priority from the prior Japanese Patent Application Nos. 2008-233912, filed on Sep. 11, 2008, 2009-106873 filed on Apr. 24, 2009, and 2009-193566 filed on Aug. 24, 2009, the entire contents of each of which are incorporated herein by reference.

TECHNICAL FIELD

The present invention relates to a valve timing control apparatus to control valve timing in an internal combustion engine.

BACKGROUND ART

Conventionally, a valve timing control apparatus, which has a housing that is rotatable synchronously with a crankshaft and a vane rotor that is rotatable synchronously with a camshaft, is known to control valve timing with hydraulic fluid supplied from a supply source, such as a pump, in accordance with rotation of an internal combustion engine. For example, in an apparatus disclosed in Patent Document 1, valve timing is controlled by varying a rotational phase of a vane rotor with respect to the housing to the advance side or the retard side by introducing hydraulic fluid from a supply source to an advance chamber or a retard chamber partitioned with vanes of the vane rotor in a rotational direction.

In the apparatus in Patent Document 1, the rotational phase is regulated at a regulation phase located between a full advance phase and a full retard phase so as to provide predetermined startability which can be obtained at the regulation phase upon start of the internal combustion engine by cranking. For example, it is desirable that before stop of the internal combustion engine, a regulation pin is inserted into a recess part so as to ensure a rotational phase regulation operation upon next starting.

PRIOR TECHNICAL DOCUMENT

Patent Document

Patent Document 1: Japanese Published Unexamined Patent Application No. 2002-357105

SUMMARY OF THE INVENTION

However, in the apparatus disclosed in Patent Document 1, when the internal combustion engine quickly stops due to occurrence of abnormality, the internal combustion engine might stop before the rotational phase is regulated to the regulation phase by insertion of the regulation pin into the recess part. When the cranking of the internal combustion engine is started in the rotational phase different from the regulation phase, the startability might be lowered. Accordingly, it may be arranged such that the rotational phase is moved to the regulation phase by utilizing variable torque which occurs during cranking and the regulation pin is inserted into the recess part.

Note that in the apparatus disclosed in Patent Document 1, the regulation pin is pressed with a spring in an insertion direction into the recess part, on the other hand, it receives pressure in an escape direction out of the recess part from the hydraulic fluid introduced in the operation chamber formed with the vane rotor. Therefore, when the hydraulic fluid remains in the operation chamber before start of the internal combustion engine, it is necessary to push the remaining hydraulic fluid out by the regulation pin in order to insert the regulation pin into the recess part during the cranking of the internal combustion engine. However, pressure loss increases upon pushing the remaining hydraulic fluid from the operation chamber especially at low temperature time when the viscosity of the hydraulic fluid increases. Accordingly, there is possibility that the moving speed of the regulation pin is lowered, and thereby the insertion of the regulation pin into the recess part is made difficult. In this manner, the conventional technique has a problem that a regulation state cannot be obtained, or the establishment of the regulation state is delayed. As a result, the startability may be lowered in some cases.

The present invention has been made in consideration of the above problem, and has its object to provide a valve timing control apparatus in which the transition to the regulation state is improved.

Another object of the present invention is to provide a valve timing control apparatus capable of suppressing degradation of startability of an internal combustion engine.

A valve timing control apparatus according to one aspect of the present invention is applied to an internal combustion engine. The valve timing control apparatus controls valve timing of a drive gear opened and closed with a camshaft in accordance with torque transmitted from a crankshaft. The valve timing control apparatus controls the valve timing with hydraulic fluid supplied from a supply source in accordance with rotation of the internal combustion engine. The valve timing control apparatus has a housing, which is rotatable synchronously with one of the crankshaft and the camshaft, and which forms a recess part recessed from its inner surface. The valve timing control apparatus has a vane rotor, which is rotatable synchronously with the other one of the crankshaft and the camshaft, and which has vanes defining an advance chamber and a retard chamber arranged in a rotational direction in an interior space of the housing. The vane rotor varies a rotational phase with respect to the housing to the advance side or the retard side by introduction of the hydraulic fluid to the advance chamber or the retard chamber. The valve timing control apparatus has a main regulation member reciprocally movably received in the vane rotor, and the main regulation member regulates the rotational phase at a regulation phase between a full advance phase and a full retard phase when the main regulation member moves in an insertion direction to be inserted into the recess part, on the other hand. The main regulation member moves in an escape direction to escape out of the recess part in order to release the rotational phase from regulation. The valve timing control apparatus has a main resilient member which urges the main regulation member in the insertion direction to insert the main regulation member into the recess part when the main resilient member urges the main regulation member at the regulation phase. On the other hand, the main resilient member brings the main regulation member into contact with an inner surface of the housing when the main resilient member urges the main regulation member at the rotational phase different from the regulation phase. The valve timing control apparatus has a sub regulation member received in the vane rotor. The sub regulation member is also reciprocally movably in the directions, in which the regulation member is movable. The sub regulation member has a pressure reception part to receive pressure in the escape direction from the hydraulic fluid introduced into the operation chamber formed with the vane rotor. The sub regulation member has an engagement part engageable with the main regulation member in the escape direction and disengageable from the main regulation member in the insertion direction. The valve timing control apparatus has a sub resilient member that urges the sub regulation member in the insertion direction. Note that the regulation phase is set as a predetermined point within a movable range or a predetermined partial region within the movable range.

In the present invention, the hydraulic fluid supplied from the supply source in accordance with the rotation of the internal combustion engine is introduced into the operation chamber formed with the vane rotor. Accordingly, when the internal combustion engine stops before the main regulation member is inserted into the recess part recessed from the inner surface of the housing and the rotational phase is regulated to the regulation phase between the full advance phase and the full retard phase, the pressure of the hydraulic fluid introduced in the operation chamber is lowered. As a result, the sub regulation member in the pressure reception part which receives pressure from the hydraulic fluid in the operation chamber in the escape direction moves to the insertion direction by the pressing with the sub resilient member. At this time, the main regulation member engaged with the engagement part of the sub regulation member in the escape direction moves in accordance with the sub regulation member by the pressing with the main resilient member. Especially in the rotational phase different from the regulation phase, the main regulation member comes into contact with the inner surface of the housing. Even in a state, where the main regulation member in contact with the inner surface of the housing does not move, the sub regulation member pressed with the sub resilient member is movable to move the engagement part in the insertion direction with respect to the main regulation member while pushing the remaining hydraulic fluid in the operation chamber with the pressure reception part. With this arrangement, upon starting to start the internal combustion engine by cranking, when the main regulation member is inserted into the recess part by varying the rotational phase to the regulation phase with variable torque which occurs during the cranking, the main regulation member can be moved at a high speed toward the engagement part away from the main regulation member, i.e., in the insertion direction. Accordingly, even at a low temperature, the rotational phase can be regulated to the regulation phase by quickly and reliably inserting the main regulation member into the recess part. As a result, degradation of startability can be suppressed.

The sub regulation member can move the main regulation member in the escape direction and get the main regulation member out of the recess part by receiving the pressure of the hydraulic fluid introduced in the operation chamber in accordance with the rotation of the internal combustion engine with the pressure reception part. Accordingly, when the main regulation member has been inserted into the recess part and the internal combustion engine has been started, it is possible to release the regulation of the rotational phase by escape of the main regulation member from the recess part, and to realize flexible valve timing control.

The main regulation member and the sub regulation member can be received in the vane rotor.

The housing may have an atmospheric hole to release the recess part side of the main regulation member to atmosphere. According to this arrangement, moving resistance to the insertion direction received from the recess part side can be reduced.

The housing may form an atmospheric hole to open the side of the main regulation member, which is opposite from the recess part, to the atmosphere. According to this arrangement, moving resistance to the insertion direction received from the opposite side can be reduced.

The housing may form an atmospheric hole to open the recess part side of the main regulation member to atmosphere and an atmospheric hole to open the other side of the main regulation member, which is opposite from the recess part, to atmosphere. The main regulation member may have a through hole communicating those atmospheric holes. According to this arrangement, even when difficulty occurs in the atmospheric release through the atmospheric hole on one of the concave side and the opposite side with respect to the main regulation member, as the one side can be communicated with the other side with the main regulation member using the though hole, the atmospheric release state on one side can be ensured. Accordingly, the moving resistance can be reduced regardless of dogging in the atmospheric hole or the like.

It may be arranged such that the sub regulation member is engaged with an outer peripheral surface of the main regulation member, the vane rotor has a support part to support the outer peripheral surface of the main regulation member, and the operation chamber is formed between the sub regulation member and the pressure reception part opposite to the support part. This reduces the action of the pressure from the hydraulic fluid introduced in the operation chamber on the main regulation member. Accordingly, it is possible to suppress reduction of the moving speed of the main regulation member.

It may be arranged such that the housing forms an opening hole opened to atmosphere, the vane rotor forms a communication hole communicating with one of the advance chamber and the retard chamber, and the sub regulation member provides communication between the opening hole and the communication hole by moving in the insertion direction from an interruption position, at which sub regulation member prohibits communication between the opening hole and the communication hole. According to this arrangement, the advance chamber or the retard chamber communicating with the communication hole is opened to atmosphere through the opening hole. Accordingly, it is possible to suppress occurrence of load on the advance chamber or the retard chamber in which the volume expands in accordance with the variable torque during cranking. Further, it is possible to suppress the degradation of shifting speed of the rotational phase due to the load.

Note that it is possible to prohibit communication between the opening hole and the communication hole by moving the sub regulation member to the interruption position. Accordingly, in such interruption state, the valve timing can be controlled by the introduction of hydraulic fluid into one of the advance chamber and the retard chamber.

It may be arranged such that a throttle member to reduce a fluid flow area is provided in a communication passage formed from the opening hole to the communication hole when the sub regulation member moves in the insertion direction. In the throttle member, the flow resistance of atmosphere is lower than the flow resistance of the hydraulic fluid. Therefore, possibility of leakage of the hydraulic fluid can be reduced, and atmosphere can be easily introduced. Accordingly, it is possible to improve the operation of suppression of the degradation of the shifting speed of the rotational phase.

It may be arranged such that the vane rotor forms an advance communication hole communicating with the advance chamber and a retard communication hole communicating with the retard chamber, and the sub regulation member communicates the advance communication hole with the retard communication hole by moving in the insertion direction from the interruption position, at which the sub regulation member prohibits communication between the advance communication hole and the retard communication hole. According to this arrangement, it is possible to move remaining hydraulic fluid through the advance communication hole and the retard communication hole communicating with the respective chambers. Accordingly, it is possible to suppress the state in which the shifting speed of the rotational phase is degraded due to the remaining hydraulic fluid in the advance chamber or the retard chamber.

Note that it is possible to prohibit communication between the advance communication hole and the retard communication hole by moving the sub regulation member to the interruption position. Accordingly, in such interruption state, the valve timing can be controlled by the introduction of hydraulic fluid into one of the advance chamber and the retard chamber.

It may be arranged such that the housing forms an opening hole opened to atmosphere, and the sub regulation member provides communication between the advance communication hole and the retard communication hole with the opening hole by moving in the insertion direction from an interruption position, at which the sub regulation member prohibits communication between the advance communication hole and the retard communication hole. According to this arrangement, it is possible to move remaining hydraulic fluid through the advance communication hole and the retard communication hole communicating with the respective chambers. In addition, upon starting, even when the viscosity of the hydraulic fluid is high and the hydraulic fluid is moved with difficulty (for example, the hydraulic fluid is in a degraded state or in a low temperature state), atmosphere can be introduced to the advance chamber and the retard chamber.

Note that it is possible to prohibit communication between the communication holes and the opening hole by moving the sub regulation member to the interruption position. Accordingly, in such interruption state, the valve timing can be controlled by the introduction of hydraulic fluid into one of the advance chamber and the retard chamber.

It may be arranged such that a throttle member to reduce a fluid flow area is provided in a communication passage formed by the movement of the sub regulation member in the insertion direction from the opening hole to the advance communication hole and the retard communication hole. According to this arrangement, in the throttle member, the flow resistance of atmosphere is lower than the flow resistance of the hydraulic fluid. Accordingly, it is possible to suppress leakage of hydraulic fluid from the advance chamber and the retard chamber and easily introduce atmosphere to the advance chamber and the retard chamber. Accordingly, it is possible to improve the operation of suppression of the reduction of shifting speed of the rotational phase.

Note that reference numerals in claims show one example of correspondence with particular examples in embodiments to be described later.

BRIEF DESCRIPTION OF DRAWINGS

The above-described or other features, structures and advantages of the present invention will be more apparent from the following description taken in conjunction with the accompanying drawings.

DESCRIPTION OF EMBODIMENTS

Figure 1:
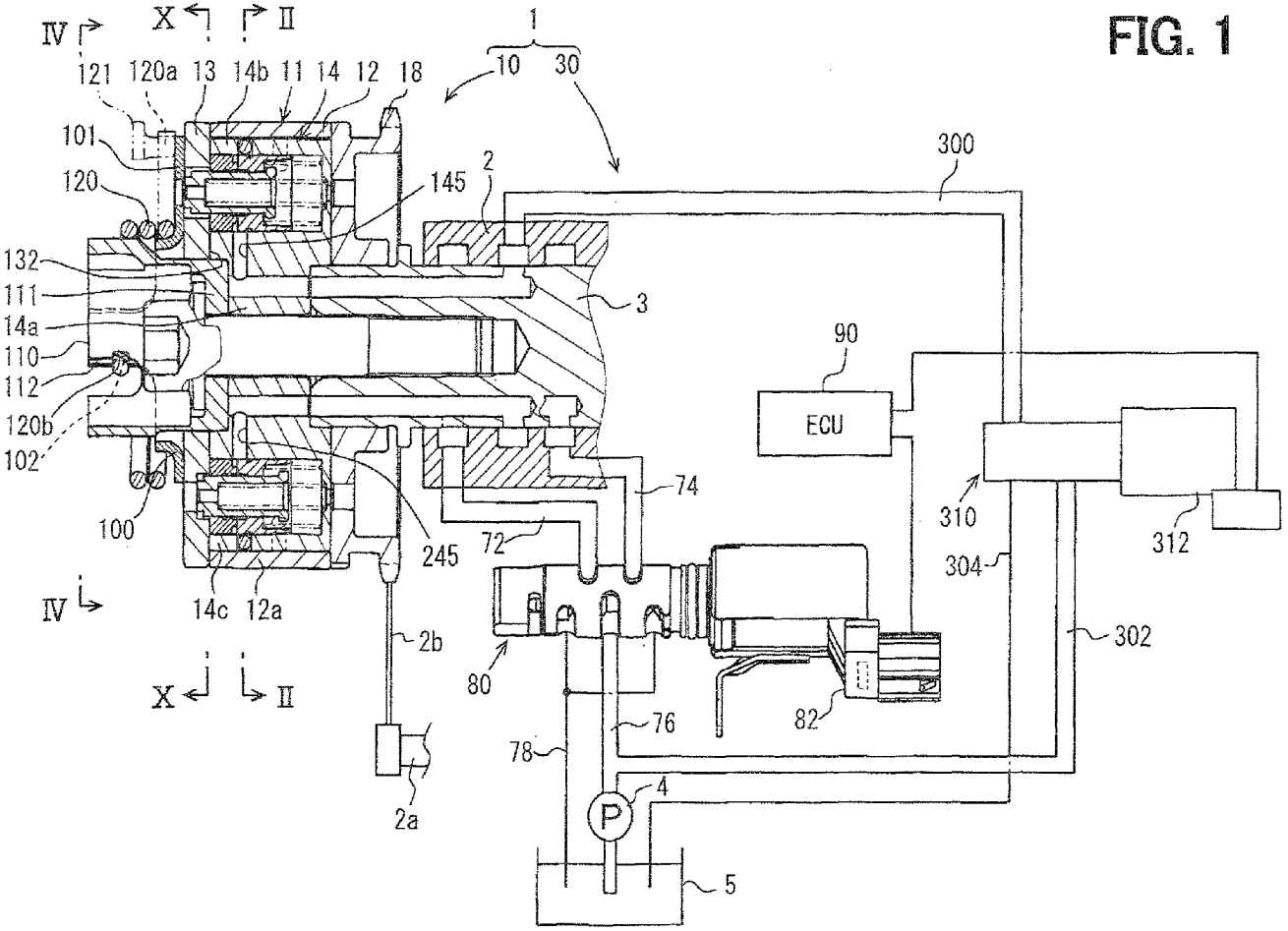
FIG. 1 illustrates a structure of a valve timing control apparatus according to a first embodiment of the present invention and is a I-I cross-sectional view in FIG. 2.

Hereinbelow, plural embodiments of the present invention will be described in accordance with the drawings. Note that in the respective embodiments, corresponding constituent elements have the same reference numerals and therefore the explanations of such constituent elements will be omitted. In the figures, an advance direction is indicated with a symbol (+), and a retard direction, a symbol (−).

First Embodiment

Hereinbelow, the first embodiment of the present invention will be described based on the drawings. FIG. 1 shows a valve timing control apparatus 1 according to the first embodiment of the present invention. The valve timing control apparatus 1 is applied to a vehicle internal combustion engine 2. The valve timing control apparatus 1 controls valve timing of an intake valve serving as a "drive gear", which is opened and closed by a camshaft 3, through oil serving as "hydraulic fluid" supplied from a pump 4 serving as a "supply source".

(Basic Structure)

Hereinbelow, the basic structure of the valve timing control apparatus 1 will be described. The valve timing control apparatus 1 has a drive unit 10 provided in a transmission system to transmit engine torque from a crankshaft 2*a* of the internal combustion engine 2 to the camshaft 3, and a control unit 30 to control operation of the drive unit 10.

(Drive Unit)

Figure 2:
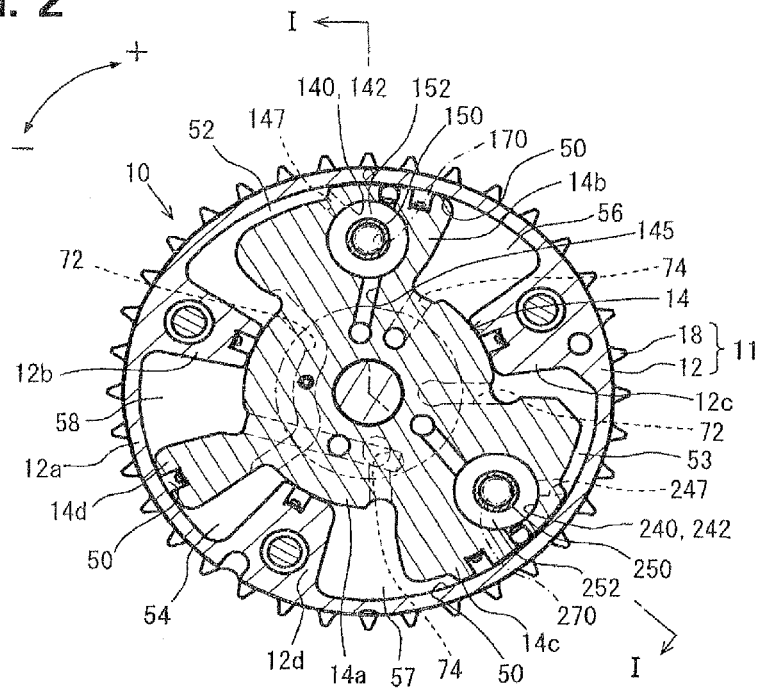
FIG. 2 is a II-II cross-sectional view in FIG. 1.

As shown in FIGS. 1 and 2, a housing 11 has a shoe member 12, a sprocket member 18, a cover member 13 and the like.

The shoe member 12 formed of metal has a tubular member 12*a* in a cylindrical shape and multiple shoes 12*b*, 12*c* and 12*d*. The respective shoes 12*b* to 12*d* project inwardly in a radial direction from positions at approximately equal intervals in a rotational direction in the tubular member 12*a*. A projecting end surface of each shoe 12*b* to 12*d* has an arc shape and it slides on an outer peripheral surface of a boss 14*a* of a vane rotor 14. A receiving chamber 50 is respectively formed between the shoes 12*b* to 12*d* adjacent in the rotational direction.

The sprocket member 18 and the cover member 13 are respectively formed using metal in a ring plate shape, and respectively coaxially fixed to both ends of the shoe member 12. The sprocket member 18 is coupled with the crankshaft through a timing chain 2*b* installed between the sprocket member 18 and the crankshaft. In this arrangement, the engine torque is transmitted from the crankshaft to the sprocket member 18 during rotation of the internal combustion engine 2, and thereby the housing 11 rotates synchronously with the crankshaft in a clockwise direction in FIG. 2.

As shown in FIGS. 1 and 2, the vane rotor 14 is formed of metal and is concentrically received in the housing 11, and its both ends in an axial direction are in slide-contact with the sprocket member 18 and the cover member 13. The vane rotor 14 has the cylindrical boss 14*a* and multiple vanes 14*b*, 14*c* and 14*d*.

The boss 14*a* is coaxially fixed to the camshaft 3. With this arrangement, the vane rotor 14 rotates synchronously with the camshaft 3 in the clockwise direction in FIG. 2. Further, the vane rotor 14 is relatively rotatable within a predetermined angular range, i.e. phase range, with respect to the housing 11. The respective vanes 14*b* to 14*d* project outwardly in the radial direction from positions of the boss 14*a* at approximately equal intervals in the rotational direction, and respectively received in the corresponding receiving chamber 50. A projecting end surface of each vane 14*b* to 14*d* has an arc shape and is in slide-contact with an inner peripheral surface of the tubular member 12*a*.

The respective vanes 14*b* to 14*d* define advance chambers 52, 53 and 54 and retard chambers 56, 57 and 58 in the housing 11 by partitioning the respectively corresponding receiving chamber 50 into halves. More particularly, the advance chamber 52 is formed between the shoe 12*b* and the vane 14*b*, the advance chamber 53 is formed between the shoe 12*c* and the vane 14*c*, and the advance chamber 54 is formed between the shoe 12*d* and the vane 14*d*. Further, the retard chamber 56 is formed between the shoe 12*c* and the vane 14*b*, the retard chamber 57 is formed between the shoe 12*d* and the vane 14*c*, and the retard chamber 58 is formed between the shoe 12*b* and the vane 14*d*.

In the drive unit 10, by oil introduction into the advance chambers 52 to 54 and oil exhaustion from the retard chambers 56 to 58, the rotational phase of the vane rotor 14 with respect to the housing 11 is varied to the advance side. Accordingly, at this time, the valve timing is advanced. On the other hand, the rotational phase is varied to the retard side by oil introduction into the retard chambers 56 to 58 and the oil exhaustion from the advance chambers 52 to 54. Accordingly, at this time, the valve timing is retarded.

(Control Unit)

As shown in FIGS. 1 and 2, an advance passage 72 provided to extend through the camshaft 3 and its bearing (not shown) always communicates with the advance chambers 52 to 54 regardless of variation of the rotational phase. Further, a retard passage 74 provided to extend through the camshaft 3 and its bearing always communicates with the retard chambers 56 to 58 regardless of variation of the rotational phase.

As shown in FIG. 1, a supply passage 76 communicates with a discharge orifice of the pump 4, and oil introduced in the inlet of the pump 4 from an oil pan 5 is discharge-supplied from the discharge orifice to the supply passage 76. Note that the pump 4 in the present embodiment is a mechanical pump which discharge-supplies oil to the supply passage 76 when it is driven with the crankshaft in accordance with rotation of the internal combustion engine 2 and which stops the discharge-supply in accordance with stop of the internal combustion engine 2. Further, a drain passage 78 is provided such that the oil can be discharged to the oil pan 5.

A phase control valve 80 is connected to the advance passage 72, the retard passage 74, the supply passage 76 and the drain passage 78. As the phase control valve 80 operates in accordance with energization to a solenoid 82, to switch a passage communicating with the respective advance passage 72 and the retard passage 74 between the supply passage 76 and the drain passage 78. For example, the phase control valve 80 switches at least an advance state and a retard state. In the advance state, the advance passage 72 and the supply passage 76 communicate with each other, and the retard passage 74 and the drain passage 78 communicate with each other. In the retard state, the advance passage 72 and the drain passage 78 communicate with each other, and the retard passage 74 and the supply passage 76 communicate with each other.

A control circuit 90 mainly having a microcomputer is electrically connected with the solenoid 82 of the phase control valve 80. The control circuit 90 is also indicated as an ECU 90. The control circuit 90 has a function of controlling energization to the solenoid 82 and a function of controlling operation of the internal combustion engine 2.

In the control unit 30, when the phase control valve 80 operates in accordance with the energization to the solenoid 82 under the control of the control circuit 90, the communication state of the supply passage 76 and the drain passage 78 with respect to the advance passage 72 and the retard passage 74 is switched. Note that when the phase control valve 80 communicates with the advance passage 72 and the retard passage 74 respectively with the supply passage 76 and the drain passage 78, the oil from the pump 4 is introduced through the passages 76 and 72 to the advance chambers 52 to 54, and the oil in the retard chambers 56 to 58 is discharged through the passages 74 and 78 to the oil pan 5. Accordingly, at this time, the valve timing is advanced. On the other hand, when the phase control valve 80 communicates the retard passage 74 and the advance passage 72 respectively with the supply passage 76 and the drain passage 78, the oil from the pump 4 is introduced through the passages 76 and 74 to the retard chambers 56 to 58, and the oil in the retard chambers 52 to 54 is discharged through the passages 72 and 78 to the oil pan 5. Accordingly, at this time, the valve timing is retarded.

Hereinbelow, the structure of the valve timing control apparatus 1 will be described in detail.

(Variable Torque Operation Structure)

Figure 3:
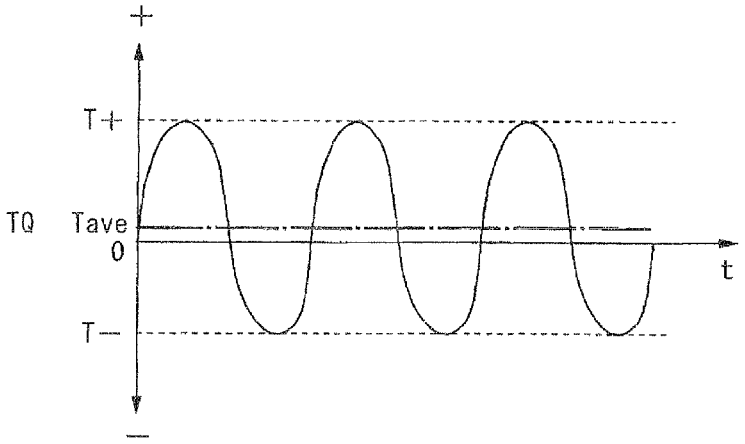
FIG. 3 shows variable torque.

During rotation of the internal combustion engine 2, variable torque due to a spring reaction force from the intake valve open/close driven with the camshaft 3 acts on the vane rotor 14. Note that as shown in FIG. 3, variable torque TQ alternates between negative torque to urge the vane rotor 14 in the advance direction of the rotational phase with respect to the housing 11 and positive torque to urge the vane rotor 14 in the retard side of the rotational phase. Then, especially the variable torque in the present embodiment shows a tendency that the peak torque T+ of the positive torque becomes higher than the peak torque T− of the negative torque due to friction between the camshaft 3 and the bearing or the like. The vane rotor 14 is pressed to the positive torque side, i.e., the retard side in the rotational phase by the amount of an average deviation with average torque Tave of the variable torque.

(Pressing Structure)

Figure 4:
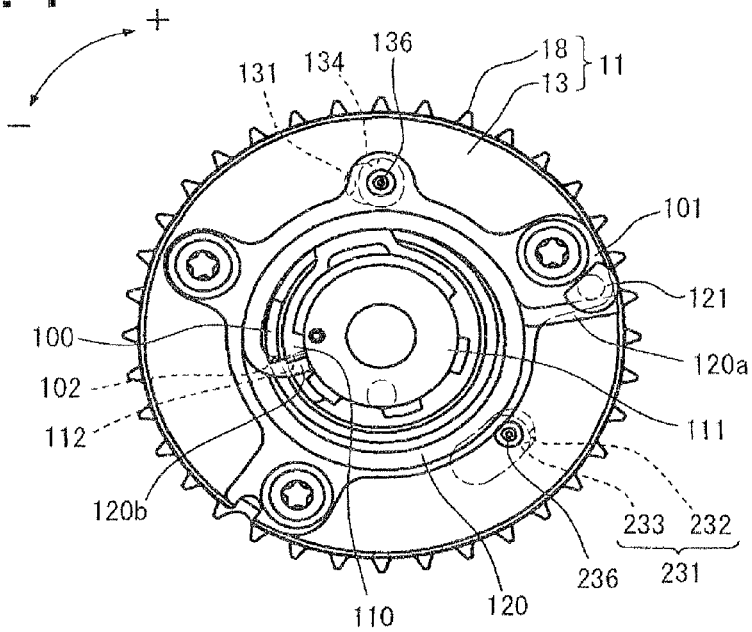
FIG. 4 is a front view of a IV-IV arrow view in FIG. 1.

As shown in FIGS. 1 and 4, a flange wall 101 of a housing bush 100 formed in a cylindrical hat shape using metal is coaxially fixed to the cover member 13. A housing groove 102 is provided to extend through the housing bush 100 in a radial direction at the end opposite from the flange wall 101.

A bottom wall 111 of a rotor bush 110 formed in a closed-end cylindrical shape using metal is coaxially fixed to the boss 14*a*. The rotor bush 110 is formed to have a diameter smaller than that of the housing bush 100, and is concentrically and relative-rotatably provided on the inner peripheral side of the housing bush 100. A rotor groove 112 is provided to extend through the rotor bush 110 in a radial direction at the end opposite from the bottom wall 111.

An urging member 120 having a metal helical torsion spring is concentrically provided on the outer peripheral side of the housing bush 100. One end 120*a* of the urging member 120 is always engaged with an engagement pin 121 fixed to the cover member 13. The other end 120*b* of the urging member 120 is inserted through the housing groove 102 and the rotor groove 112 from the outside to the inside in the radial direction.

Figure 5:
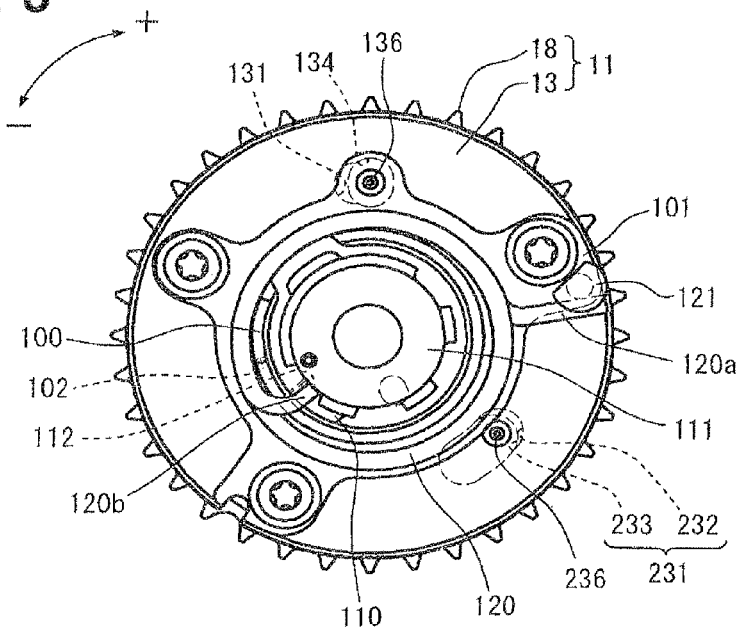
FIG. 5 is a front view showing another operation state.

When the rotational phase is located between the full retard phase shown in FIG. 5 and a predetermined lock phase shown in FIG. 4, the end 120*b* of the urging member 120 is stopped by the rotor groove 112 from the advance side. At this time, because the end 120*b* of the urging member 120 is not stopped by the housing groove 102, a restoring force, which occurs by torsional deformation of the urging member 120, acts on the rotor groove 112 against the average torque Tave of the variable torque during rotation of the internal combustion engine 2. With this arrangement, the vane rotor 14 together with the rotor bush 110 is urged in the advance direction of the rotational phase.

Figure 6:
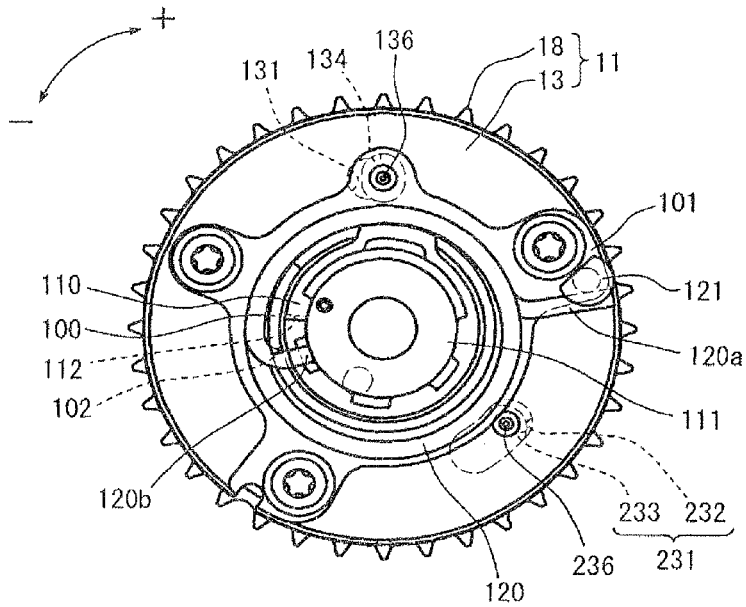
FIG. 6 is a front view showing another operation state.

On the other hand, when the rotational phase is located between the lock phase shown in FIG. 4 and the full advance phase shown in FIG. 6, the end 120*b* of the urging member 120 is stopped by the housing groove 102 from the advance side. At this time, because the end 120*b* of the urging member 120 is not stopped by the rotor groove 112, the restoring force of the urging member 120 acts only on the housing bush 100. A bias means is formed so as to realize the urging of the vane rotor 14 in the advance direction when the rotational phase is on the retard side of the lock phase, but not to realize the urging when the rotational phase is on the advance side of the lock phase.

Note that a region from an intermediate phase between the full retard phase and the full advance phase to the full advance phase is set as a regulation phase region. Further, the lock phase is set as a regulation phase. Accordingly, the regulation phase region includes the lock phase. According to these settings, during cranking to start the internal combustion engine 2, extreme reduction of cylinder intake air amount due to delay of closing of the intake valve can be suppressed.

(First Regulation-Lock Structure)

Figure 7:
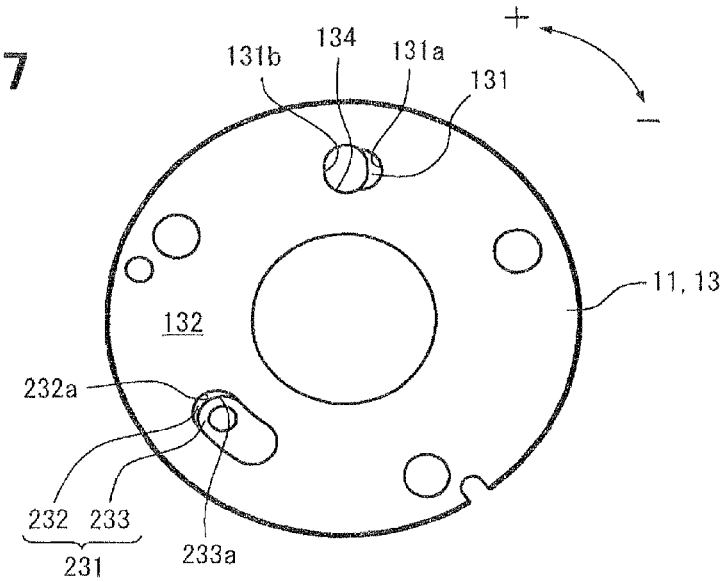
FIG. 7 is a plane view of a cover member in FIG. 1.
Figure 8:
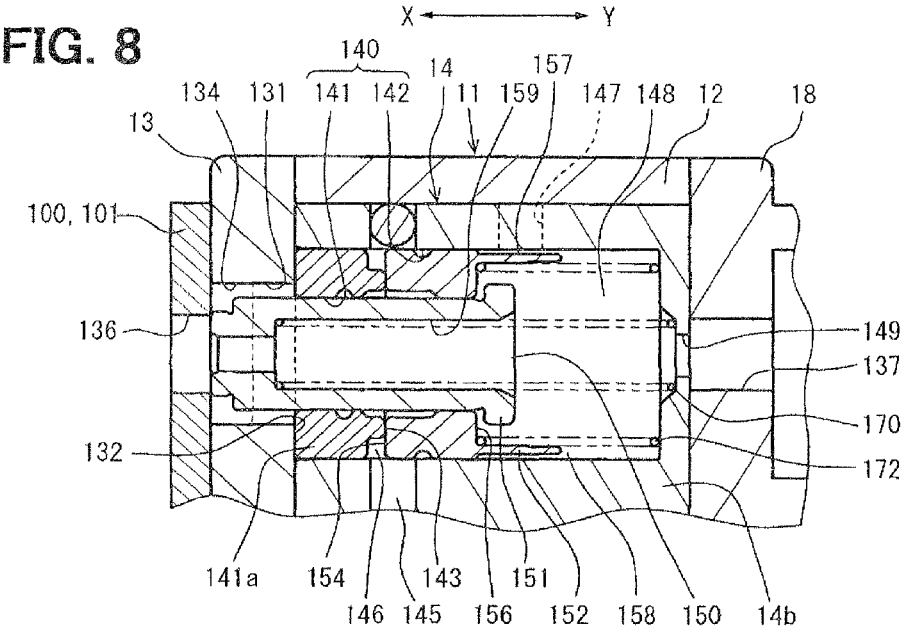
FIG. 8 is an enlarged cross-sectional view showing a part of FIG. 1.

As shown in FIGS. 7 and 8, the cover member 13 of the housing 11 forms a first regulation recess part 131 and a lock recess part 134. The first regulation recess part 131 opens in the inner surface 132 of the cover member 13 and extends in a rotational direction of the housing 11, and both closed rotational ends are provided with a pair of regulation stoppers 131*a* and 131*b*. The lock recess part 134 has a closed-end tubular shape axially parallel to the camshaft 3, and opens in a bottom surface of the regulation recess part 131 at an advance end of the first regulation recess part 131.

As shown in FIGS. 4 and 8, the housing bush 100, which serves as the bottom surface of the lock recess part 134, forms an atmospheric hole 136. The atmospheric hole 136 of the housing bush 100 has a cylindrical hole shape axially parallel to the camshaft 3, and has a diameter smaller than the width of the lock recess part 134. The atmospheric hole, formed to extend through the flange wall 101, is always atmospherically opened. As shown in FIG. 8, the sprocket member 18 of the housing 11 forms another atmospheric hole 137 in a position on a side of the vane rotor 14 opposite from the atmospheric hole 136. The atmospheric hole 137 of the sprocket member 18 has a cylindrical hole shape axially parallel to the camshaft 3, and has a diameter smaller than a large diameter support part 142 of a first receiving hole 140, which will be described later. The atmospheric hole, formed to extend through the sprocket member 18, always opens to atmosphere.

As shown in FIGS. 2 and 8, the vane 14*b* of the vane rotor 14 has the first receiving hole 140 and a first through hole 149. The first receiving hole 140 has a closed-end cylindrical shape axially parallel to the camshaft 3, and opens in a slide end surface of the vane rotor 14 with respect to the inner surface 132 of the cover member 13. The first receiving hole 140 has a small diameter support part 141 on the opening side as the cover member 13 side. The small diameter support part 141 is formed to face the first regulation recess part 131 and the lock recess part 134 respectively in a predetermined rotational phase. The small diameter support part 141 is formed with an inner peripheral surface of a sleeve 141*a* engagedly fixed to a main body of the vane rotor 14.

The first receiving hole 140 has the large diameter support part 142 having a diameter larger than that of the small diameter support part 141 on the bottom surface side opposite from the cover member 13. The large diameter support part 142 defines an operation chamber 146 between the sleeve 141*a* and a first main regulation member 150 and a first sub regulation member 152. A first regulation passage 145 formed through the vane rotor 14 is opened at one end of the large diameter support part 142 on the cover member 13 side. The first regulation passage 145 and the operation chamber 146 always communicate with each other. The oil can enter the operation chamber 146 through the first regulation passage 145. Further, the large diameter support part 142 forms a communication chamber 148 at the opposite end to the cover member 13. The communication chamber 148 is capable of communicating with the advance chamber 52 via a first advance communication hole 147 formed through the vane rotor 14.

As shown in FIG. 8, the first through hole 149 has a long hole shape, which is axially parallel to the camshaft 3, which has a width narrower than the large diameter support part 142 of the first receiving hole 140, and which extends in a rotational direction. The first through hole 149 is formed between the slide end surface of the vane rotor 14 with respect to the inner surface of the sprocket member 18 and the bottom surface of the first receiving hole 140. In this arrangement, the first through hole 149 communicates with the atmospheric hole 137 of the sprocket member 18 only in a predetermined region in the rotational phase including the lock phase. Further, the first through hole 149 always communicates with the communication chamber 148.

As shown in FIGS. 2 and 8, the metal cylindrical regulation members 150 and 152 are concentrically received in the first receiving hole 140. As shown in FIG. 8, the first main regulation member 150, with its outer peripheral surface supported with the small diameter support part 141, is reciprocally movable in an axial direction. The first main regulation member 150 forms a projection member 151 in a ring plate shape projecting to the outer peripheral side at its end opposite to the cover member 13 side. Further, the first main regulation member 150 has a through hole 159 always communicating the cover member 13 side with the opposite side with an inner peripheral hole.

Figure 9:
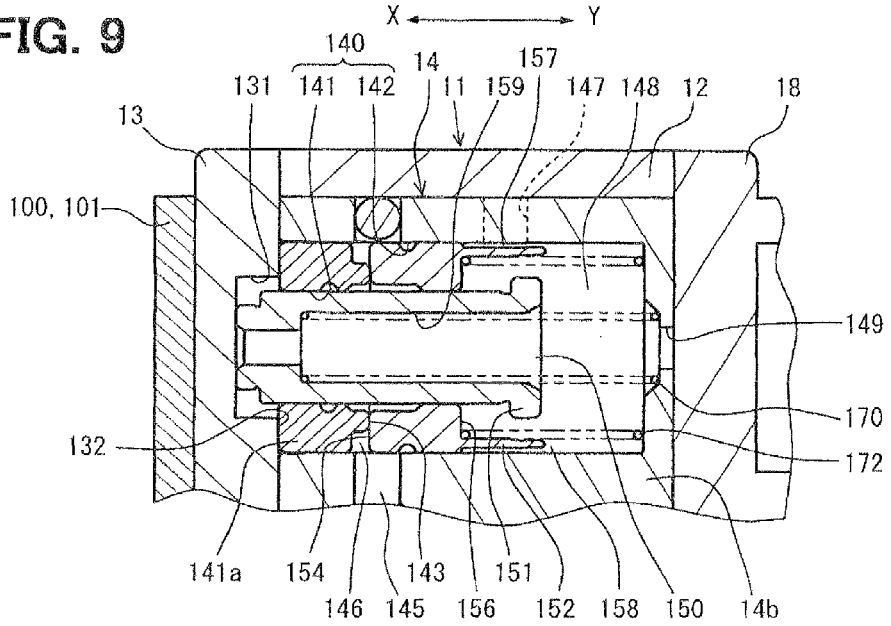
FIG. 9 is an enlarged cross-sectional view showing another operation state.
Figure 10:
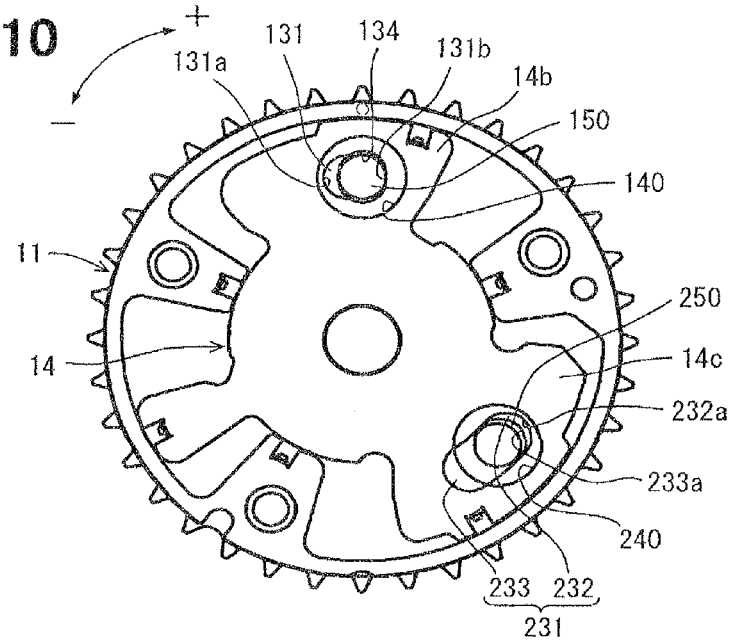
FIG. 10 is a plane view showing an arrangement of parts in an X-X cross section in FIG. 1.
Figure 11:
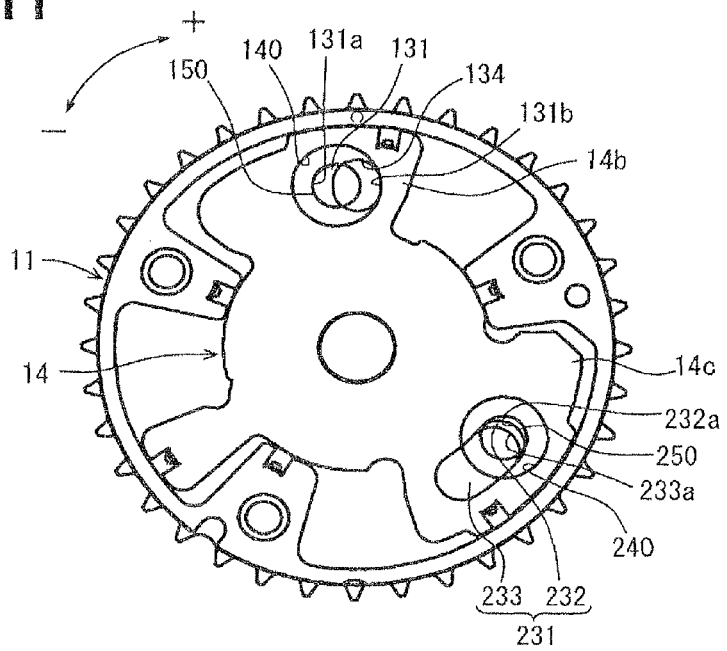
FIG. 11 is a plane view showing another operation state.

Note that the first main regulation member 150 is inserted into the first regulation recess part 131 of the housing 11 as shown in FIG. 9 by moving in an insertion direction X in the region of the regulation phase. The first main regulation member 150 inserted in the first regulation recess part 131 is stopped by a regulation stopper 131*a* formed at a retard end of the regulation recess part 131 as shown in FIG. 11, to regulate variation of the rotational phase in the retard direction to a first regulation phase, which is a retard side limit within the region of the regulation phase. On the other hand, the first main regulation member 150 inserted in the first regulation recess part 131 is stopped by a regulation stopper 131*b* at an advance end of the regulation recess part 131 as shown in FIG. 10, to regulate variation of the rotational phase in the advance direction to the lock phase.

Further, the first main regulation member 150 is inserted into the lock recess part 134 of the housing 11 as shown in FIG. 8 when the first main regulation member 150 moves in the insertion direction X at the lock phase. The first main regulation member 150 regulates the advance side and retard side variations of the rotational phase by engagement with the lock recess part 134, to lock the rotational phase to the lock phase.

Figure 12:
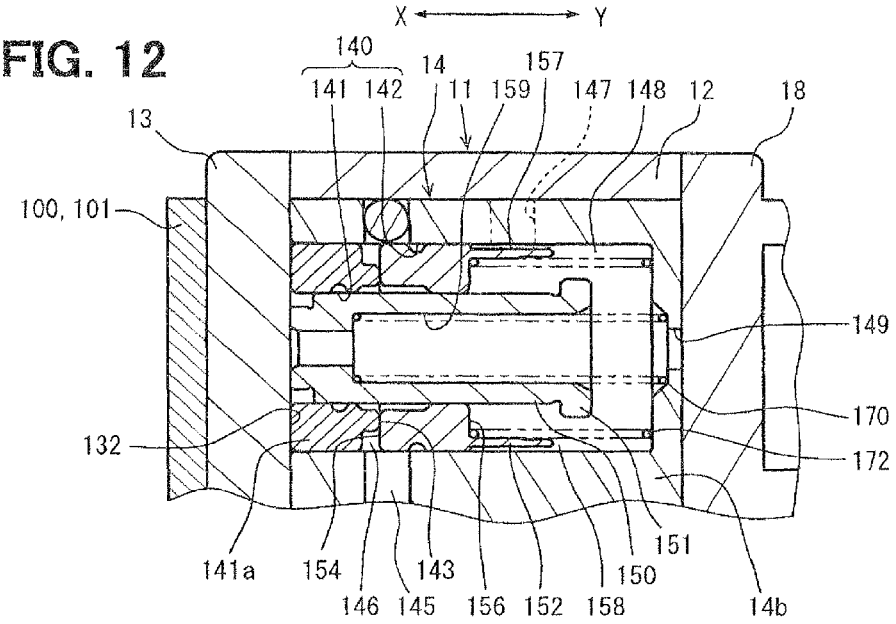
FIG. 12 is an enlarged cross-sectional view showing another operation state.
Figure 13:
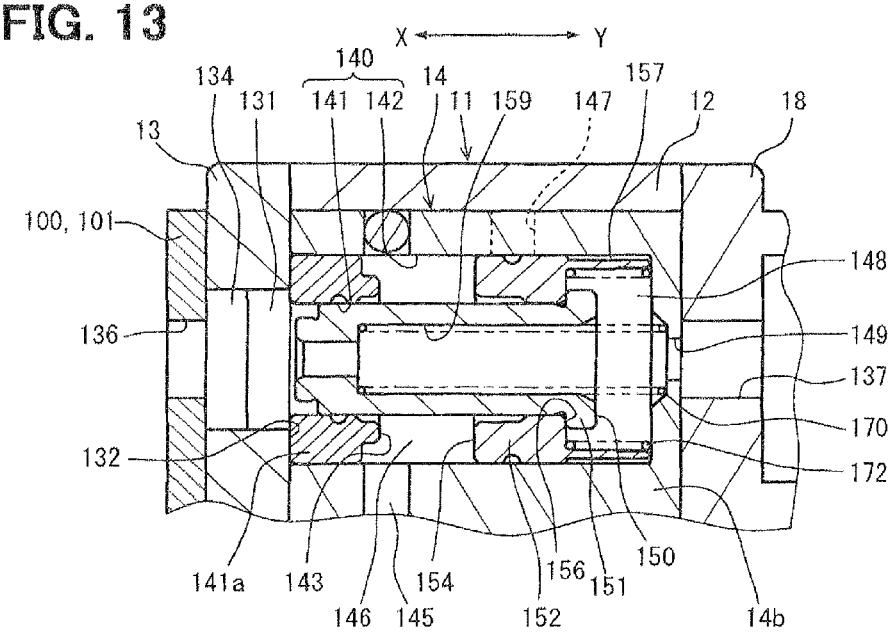
FIG. 13 is an enlarged cross-sectional view showing another operation state.

Further, the first main regulation member 150 escapes out of both the lock recess part 134 and the first regulation recess part 131 of the housing 11 by moving in an escape direction Y as shown in FIGS. 12 and 13 in the region of the regulation phase. As a result, the rotational phase is released from the regulation, and thereby the rotational phase is allowed to be changeable in the entire region within the movable range as shown in FIGS. 10, 11, and 14 to 17.

With respect to the above-described first main regulation member 150, the first sub regulation member 152 as shown in FIG. 8 is engaged with an outer peripheral surface of the first main regulation member 150 on the large diameter support part 142 side from the small diameter support part 141 of the first receiving hole 140, with its outer peripheral surface supported by the large diameter support part 142. The first sub regulation member 152 in the above engagement and support state is reciprocally movable in the axial direction, in which the first main regulation member 150 is also movable, and is movable relatively to the first main regulation member 150. In this relative movable state, the first main regulation member 150 and the first sub regulation member 152 are slidable relative to each other.

The first sub regulation member 152 has a pressure reception part 154 exposed to the operation chamber 146. The operation chamber 146 is defined between the sleeve 141*a* provided as a support part and the pressure reception part 154 that faces the sleeve 141*a*. The pressure reception part 154 faces an end surface 143 formed on the side of the sleeve 141*a* opposite from the cover member 13 side. The pressure reception part 154 is a ring shaped end surface facing toward the cover member 13. When the pressure reception part 154 receives pressure in the escape direction Y from the oil in the operation chamber 146, a first driving force that drives the first sub regulation member 152 in the escape direction Y occurs.

Further, the first sub regulation member 152 has an engagement part 156 by a ring step surface away from the cover member 13. The engagement part 156 is exposed to the communication chamber 148 and faces the bottom surface of the large diameter support part 142. In a state, where the engagement part 156 is engaged with the projection member 151 to push the projection member 151 in the escape direction Y as shown in FIG. 13, it is possible to transmit the first driving force occurring in the first sub regulation member 152 to the first main regulation member 150 and to integrally drive the regulation members 150 and 152 in the escape direction Y.

Further, the first sub regulation member 152 forms a peripheral groove 157 recessed from its outer peripheral surface of the first sub regulation member 152. The peripheral groove 157 opens to the end surface of the first sub regulation member 152 opposite from the cover member 13. The first sub regulation member 152 is movable to an interruption position, at which the first sub regulation member 152 prohibits communication between the peripheral groove 157 and the first advance communication hole 147 as shown in FIG. 13. Further, the first through hole 149 is communicable with the first advance communication hole 147 via the communication chamber 148 and the peripheral groove 157 when the first sub regulation member 152 moves from the interruption position in the insertion direction X to a position as shown in FIGS. 8, 9 and 12. Accordingly, in the region of the rotational phase, where the first through hole 149 communicates with the atmospheric hole 137, there is formed a first communication passage 158, which connects the atmospheric hole 137 with the first advance communication hole 147 through the first through hole 149, the communication chamber 148 and the peripheral groove 157, when the peripheral groove 157 is communicated with the first advance communication hole 147. Further, in the first communication passage 158, a depth of the peripheral groove 157 in the radial direction is designed so as to reduce the flow area of the fluid in the peripheral groove 157.

Resilient members 170 and 172 are concentrically received in a part of the first receiving hole 140 including at least the communication chamber 148. The first main resilient member 170 is a metal compression coil spring provided between the bottom surface of the large diameter support part 142 and the first main regulation member 150. The first main resilient member 170 urges the main regulation member 150 in the insertion direction X by causing a first main restoring force by compression deformation between the large diameter support part 142 and the first main regulation member 150. Accordingly, it is possible to bring the first main regulation member 150 into contact with an inner surface 132 of the cover member 13 as shown in FIG. 12 by driving the first main regulation member 150 in the insertion direction X with the first main restoring force of the first main resilient member 170 when the rotational phase is out of the region of the regulation phase including the full retard phase in FIG. 14. Further, in a state, where the engagement part 156 is engaged with the projection member 151 as shown in FIG. 13, it is possible to integrally drive the first main regulation member 150, together with the first sub regulation member 152, in the insertion direction X with the first main restoring force of the first main resilient member 170.

With respect to the above-described first main resilient member 170, the first sub resilient member 172 is a metal compression coil spring provided between the bottom surface of the large diameter support part 142 and the first sub regulation member 152. The first sub resilient member 172 urges the sub regulation member 152 in the insertion direction X by causing a first sub restoring force by compression deformation between the large diameter support part 142 and the first sub regulation member 152. Accordingly, in a state, where the first main regulation member 150 is in contact with the inner surface 132 of the cover member 13 when the rotational phase is out of the region of the regulation phase as shown in FIG. 12, it is possible to drive only the first sub regulation member 152 in the insertion direction X with the first sub restoring force of the first sub resilient member 172 to disengage the engagement part 156 from the projection member 151 in the insertion direction X. Further, regarding the first sub regulation member 152, the engagement part 156 of which has been moved away from the projection member 151 by the first sub restoring force of the first sub resilient member 172, it is possible to bring the pressure reception part 154 of the first sub regulation member 152 into contact with the end surface 143 of the sleeve 141*a* as shown in FIGS. 8, 9 and 12.

(Second Regulation Structure)

Figure 18:
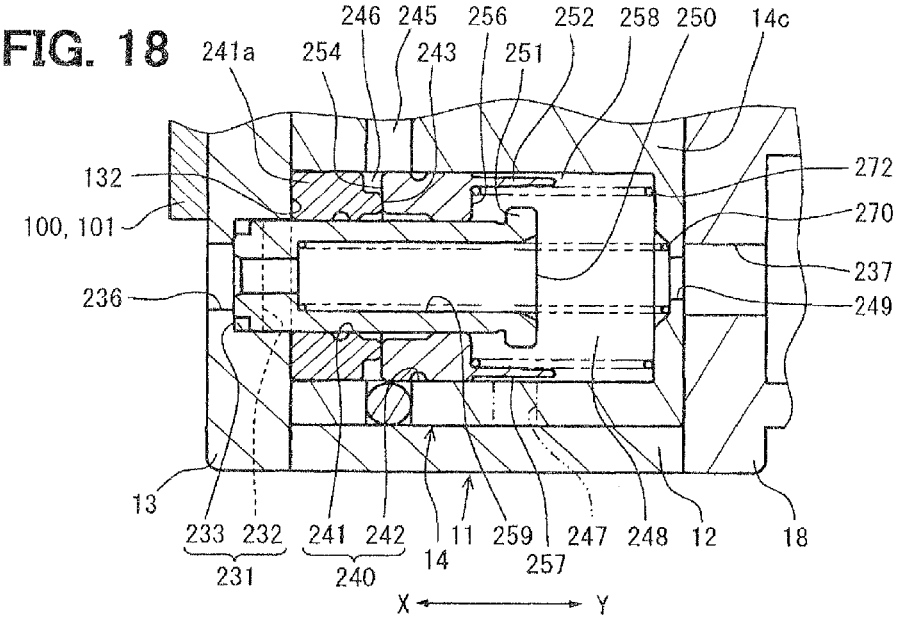
FIG. 18 is an enlarged cross-sectional view showing a part of FIG. 1.

As shown in FIGS. 7 and 18, the cover member 13 of the housing 11 forms a second regulation recess part 231. The second regulation recess part 231 opens in the inner surface 132 of the cover member 13 and extends in the rotational direction of the housing 11. Because the advance side of the second regulation recess part 231 is recessed by one step from the retard side of the second regulation recess part 231, it has a shallow bottom part 232 and a deep bottom part 233. Regulation stoppers 232*a* and 233*a* are provided at respective closed retard ends of the shallow bottom part 232 and the deep bottom part 233 of the second regulation recess part 231.

As shown in FIGS. 4 and 18, the cover member 13 forms an atmospheric hole 236. The atmospheric hole 236 of the cover member 13 has a cylindrical hole shape axially parallel to the camshaft 3 with a diameter smaller than the width of the deep bottom part of the second regulation recess part 231. The atmospheric hole 236, formed through the outer surface of the cover member 13 to the bottom surface of the deep bottom part 233, always opens to atmosphere. As shown in FIG. 18, the sprocket member 18 forms another atmospheric hole 237 on a side of the vane rotor 14 opposite from the atmospheric hole 236. The atmospheric hole 237 of the sprocket member 18 has a cylindrical hole shape axially parallel to the camshaft 3 with a diameter smaller than a large diameter support part 242 of a second receiving hole 240 to be described later. The atmospheric hole formed through the sprocket member 18 is always atmospherically opened.

As shown in FIGS. 2 and 18, the vane 14*c* of the vane rotor 14 has the second receiving hole 240 and a second through hole 249. The second receiving hole 240 has a structure similar to the first receiving hole 140. Note that a small diameter support part 241 of the second receiving hole 240 is formed so as to face the shallow bottom part 232 and the deep bottom part 233 of the second regulation recess part 231 at a corresponding predetermined rotational phase. Further, the small diameter support part 241 is formed with an inner peripheral surface of a sleeve 241*a* engageably fixed to the main body of the vane rotor 14. Further, a large diameter support part 242 of the second receiving hole 240 defines an operation chamber 246 between the sleeve 241*a* and a second main regulation member 250 and a second sub regulation member 252. The sleeve 241*a* and a pressure reception part 254 of the second sub regulation member 252 are opposite to each other. A second regulation passage 245 formed through the vane rotor 14 is opened at the end of the large diameter support part 242 adjacent the cover member 13. The second regulation passage 245 and the operation chamber 246 always communicate with each other. The oil can enter the operation chamber 246 through the second regulation passage 245. Further, the large diameter support part 242 defines a communication chamber 248 at the end opposite from the cover member 13. The communication chamber 248 is communicable with the advance chamber 53 via the second advance communication hole 247 formed to extend through the vane rotor 14.

As shown in FIG. 18, the second through hole 249 has a long hole shape which is axially parallel to the camshaft 3 and has a width smaller than the large diameter support part 242 and which extends in the rotational direction. The second through hole 249 is formed through the slide end surface of the vane rotor 14 with respect to the inner surface of the sprocket member 18 and the bottom surface of the second receiving hole 240. In this arrangement, the second through hole 249 communicates with the atmospheric hole 237 of the sprocket member 18 only in a predetermined region in the rotational phase including the lock phase. Further, the second through hole 249 always communicates with the communication chamber 248.

As shown in FIGS. 2 and 18, the respectively metal cylindrical regulation members 250 and 252 are both concentrically received in the second receiving hole 240. The second regulation member 250 with its outer peripheral surface supported by the small diameter support part 141 is reciprocally movable in the axial direction, with a structure similar to the first main regulation member 150 as shown in FIG. 18, and forms a projection member 251 and a through hole 259.

Figure 15:
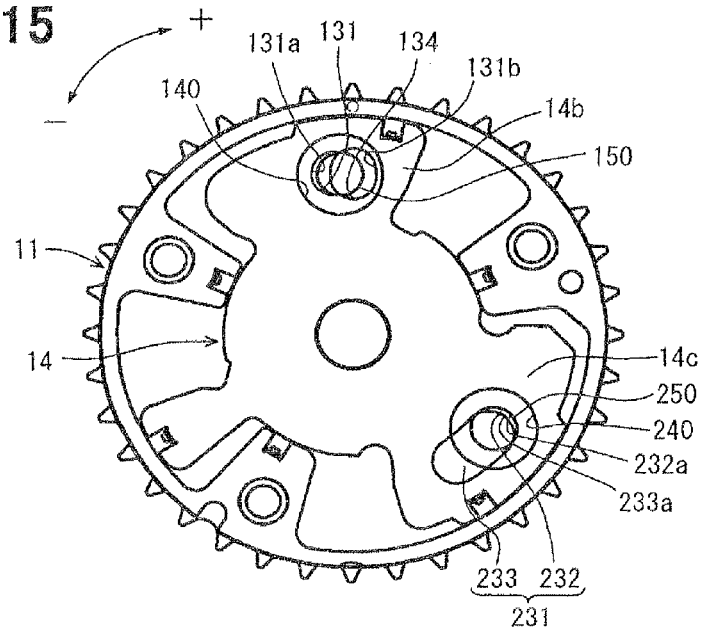
FIG. 15 is a plane view showing another operation state.
Figure 16:
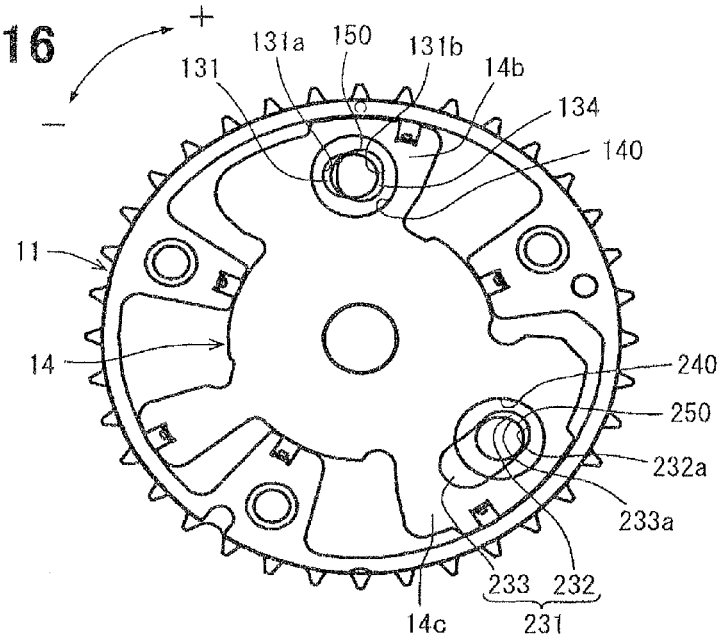
FIG. 16 is a plane view showing another operation state.
Figure 19:
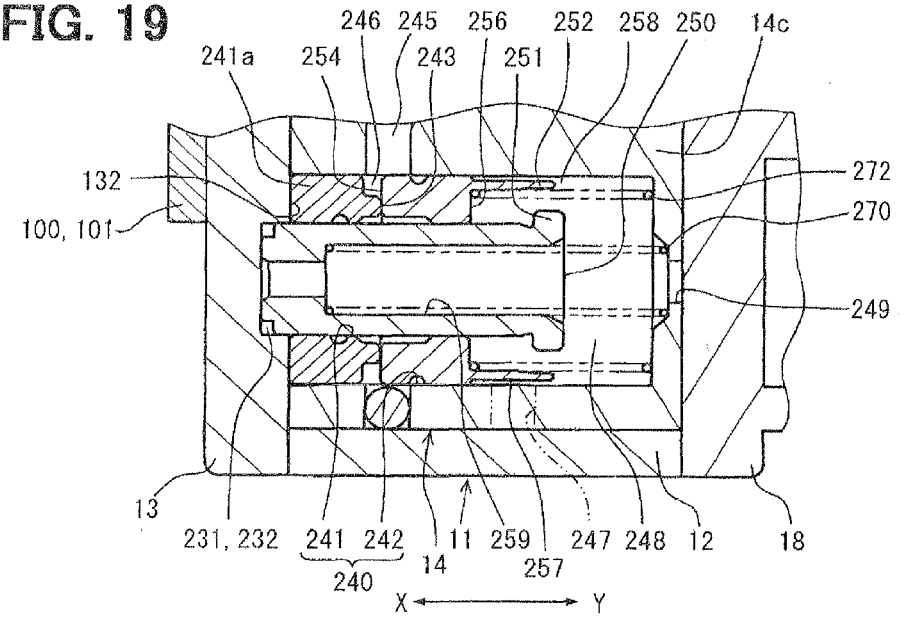
FIG. 19 is an enlarged cross-sectional view showing another operation state.

Note that the second main regulation member 250 is inserted into the shallow bottom part 232 or the deep bottom part 233 on the retard side in the second regulation recess part 231 of the housing 11 as shown in FIG. 19 or 18, respectively, when the second main regulation member 250 moves in the insertion direction X in the region of the regulation phase. The second main regulation member 250 inserted in the shallow bottom part 232 is stopped by the regulation stopper 232*a* at the retard end of the shallow bottom part 232 as shown in FIG. 15, to regulate the variation of the rotational phase in the retard direction to a second regulation phase on the advance side of the first regulation phase in the region of the regulation phase. On the other hand, the second main regulation member 250 inserted in the deep bottom part 233 is stopped by the regulation stopper 233*a* at the retard end of the deep bottom part 233 as shown in FIG. 16, to regulate the variation of the rotational phase in the retard direction to a third regulation phase on the advance side of the second regulation phase and on the retard side of the lock phase in the region of the regulation phase.

Figure 20:
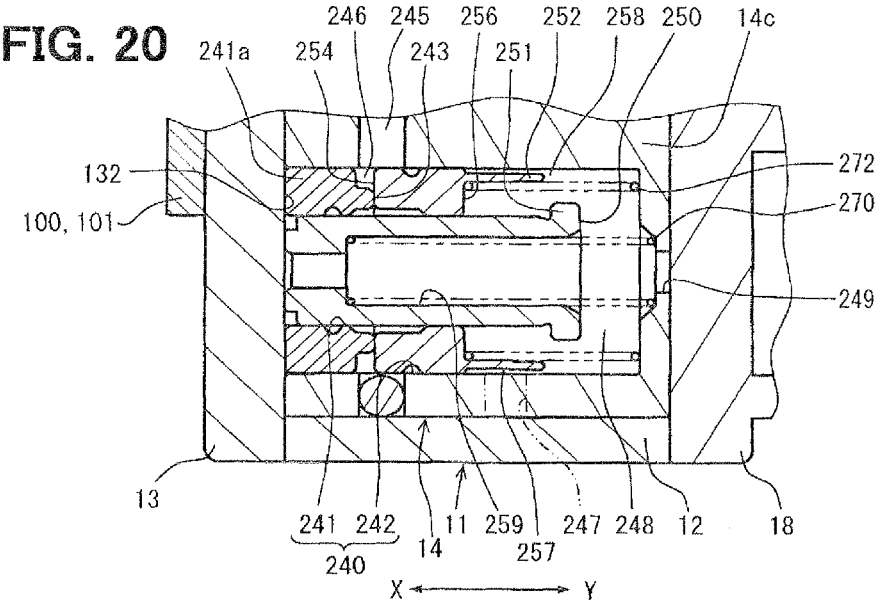
FIG. 20 is an enlarged cross-sectional view showing another operation state.
Figure 21:
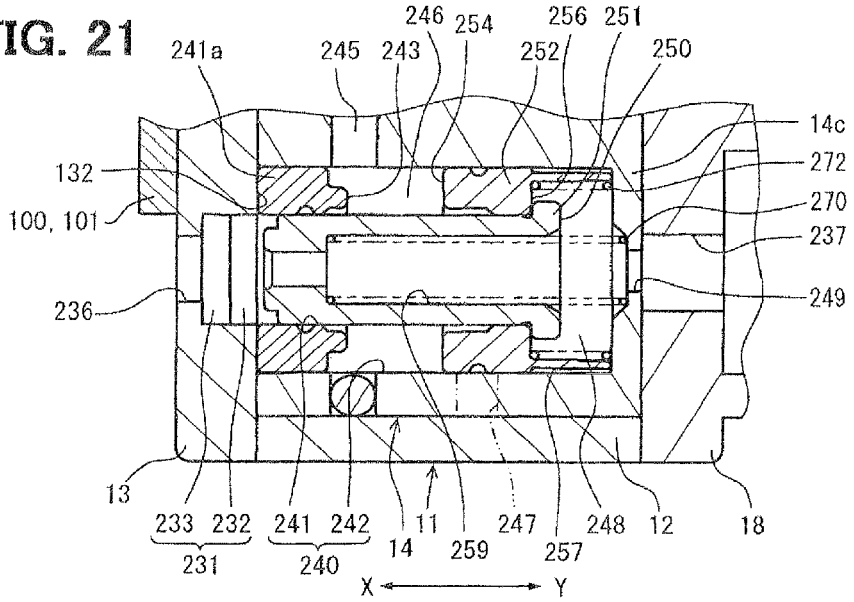
FIG. 21 is an enlarged cross-sectional view showing another operation state.

Further, the second main regulation member 250 escapes out of the second regulation recess part 231 of the housing 11 by moving in the escape direction Y as shown in FIGS. 20 and 21 in the region of the regulation phase. As a result, the rotational phase is released from regulation, and thereby as shown in FIGS. 10, 11, 14 to 17, the rotational phase is allowed to be changeable to any position within the entire movable range.

The second sub regulation member 252 has the structure similar to the first sub regulation member 152 as shown in FIG. 18, and is engaged with the outer peripheral surface of the above-described second main regulation member 250. The second sub regulation member 252 is reciprocally movable in the axial direction, in which the second main regulation member 250 is also movable, and relatively movable with respect to the second main regulation member 250. Further, the second sub regulation member 252 having the structure similar to the first sub regulation member 152 forms a pressure reception part 254 and an engagement part 256. Accordingly, when the pressure reception part 254 receives pressure in the escape direction Y from the oil in the operation chamber 246, a second driving force to drive the second sub regulation member 252 in the escape direction Y occurs. Further, in a state, where the engagement part 256 is engaged with the projection member 251 so as to urge the projection member 251 in the escape direction Y as shown in FIG. 21, it is possible to transmit the second driving force that occurs in the second sub regulation member 252 to the second main regulation member 250 and integrally drive the regulation members 250 and 252 in the escape direction Y.

Further, the second sub regulation member 252 in the present embodiment having the structure similar to the first sub regulation member 152 forms a peripheral groove 257. In this arrangement, the second through hole 249 is communicable with the second advance communication hole 247 via the communication chamber 248 and the peripheral groove 257 as shown in FIGS. 18 to 20 when the second sub regulation member 252 moves in the insertion direction X from the interruption position, at which the second sub regulation member 252 prohibits the communication between the peripheral groove 257 and the second advance communication hole 247 as shown in FIG. 21. Accordingly, in the rotational lock phase, in which the second through hole 249 is communicated with the atmospheric hole 237 as shown in FIG. 18, there is formed a second communication passage 258, which connects the atmospheric hole 237 with the second advance communication hole 247 when the peripheral groove 257 is communicated with the second advance communication hole 247. Furthermore, the flow area is reduced at the peripheral groove 257 in the passage 258.

In the second receiving hole 240, resilient members 270 and 272 are concentrically received in a part including at least the communication chamber 248. The second main resilient member 270 having a structure similar to the first main resilient member 170 causes a second main restoring force to urge the second main regulation member 250 in the insertion direction X. Accordingly, in a position out of the region of the regulation phase including the full retard phase in FIG. 14, it is possible to bring the second main regulation member 250 into contact with the inner surface 132 of the cover member 13 as shown in FIG. 20 by driving the second main regulation member 250 in the insertion direction X with the second main restoring force of the second main resilient member 270. Further, in a state, where the engagement part 256 is engaged with the projection member 251 as shown in FIG. 21, it is possible to drive the second main regulation member 250, along with the second sub regulation member 252, in the insertion direction X with the second main restoring force of the second resilient member 270.

With respect to the above-described second main resilient member 270, the second sub resilient member 272 having the structure similar to the first sub resilient member 172 causes a second sub restoring force to urge the second sub regulation member 252 in the insertion direction X. Accordingly, in a state, where the second main regulation member 250 is in contact with the inner surface 132 of the cover member 13 as shown in FIG. 20 in a position out of the region of the regulation phase, it is possible to disengage the engagement part 256 from the projection member 251 in the insertion direction X by driving only the second sub regulation member 252 in the insertion direction X with the second sub restoring force of the second sub resilient member 272. Further, regarding the second sub regulation member 252, the engagement part 256 of which has been moved away from the projection member 251 by the second sub restoring force of the second sub regulation member 272, it is possible to bring the pressure reception part 254 of the second sub regulation member 252 into contact with an end surface 243 of the sleeve 241*a* that faces the pressure reception part 254. The end surface 243 is formed on the side of the sleeve 241*a* opposite from the cover member 13 as shown in FIGS. 18 to 20.

(Driving Force Control)

As shown in FIG. 1, a driving passage 300 provided through the camshaft 3 and its bearing always communicates with the passages 145 and 245 regardless of variation of the rotational phase. Further, a branch passage 302 branched from the supply passage 76 receives oil supply from the pump 4 via the supply passage 76. Further, the drain passage 304 is provided so as to discharge the oil to the oil pan 5.

The driving control valve 310 is mechanically connected with the driving passage 300, the branch passage 302 and the drain passage 304. The driving control valve 310 switches a passage to communicate with the driving passage 300 between the branch passage 302 and the drain passage 304 by operating in accordance with energization to the solenoid 312 electrically connected with the control circuit 90.

Note that when the driving control valve 310 communicates the branch passage 302 with the driving passage 300, the oil from the pump 4 is introduced through the passages 76, 302, 300, 145, and 245 to the respective operation chambers 146 and 246. Accordingly, at this time, the driving force in the escape direction Y to drive the first and second sub regulation members 152 and 252 occurs. On the other hand, when the driving control valve 310 communicates the drain passage 304 with the driving passage 300, the oil in the operation chambers 146 and 246 is discharged through the passages 145, 245, 300 and 304 to the oil pan 5. Accordingly, at this time, the driving force to drive the first and second sub regulation members 152 and 252 is removed.

Hereinbelow, the operation of the valve timing control apparatus 1 will be described in detail.

(Normal Operation)

First, a normal operation for regularly stopping the internal combustion engine 2 will be described.

(I) In the normal stop to stop the internal combustion engine 2 in accordance with a stop command, such as turn-off of the ignition switch, the control circuit 90 controls energization to the phase control valve 80 to communicate the supply passage 76 with the advance passage 72. At this time, the internal combustion engine 2 rotates by inertia until the full stop. As the number of revolutions of the engine 2 are reduced, the pressure of the oil introduced from the pump 4 through the passages 76 and 72 to the advance chambers 52 to 54 is lowered. As a result, the force which acts on the vane rotor 14 with the pressure of the oil introduced to the advance chambers 52 to 54 is reduced. Especially in the rotational phase on the retard side of the lock phase, the restoring force of the urging member 120 to urge the vane rotor 14 becomes dominant.

Further, upon a normal stop of the internal combustion engine 2 in response to the stop command, the control circuit 90 controls the energization to the driving control valve 310 to communicate the drain passage 304 with the driving passage 300. At this time, the oil in the operation chambers 146 and 246 is discharged through the passages 145, 245, 300, and 304, and the driving force to drive the first and second sub regulation members 152 and 252 is removed. As a result, the first and second sub regulation members 152 and 252 move in the insertion direction X while pressing the oil in the operation chambers 146 and 246 to the passages 145 and 245, to bring the pressure reception parts 154 and 254 into contact with the end surfaces 143 and 243 of the small diameter support parts 141 and 241, with the restoring forces of the first and second sub resilient members 172 and 272. At the same time, the first and second main regulation members 150 and 250 move in the insertion direction X in accordance with the first and second sub regulation members 152 and 252 with the restoring forces of the first and second main resilient members 170 and 270, to a moving position corresponding to the rotational phase upon the stop command.

Accordingly, thereafter, locking the rotational phase to the lock phase is realized with the operation corresponding to the rotational phase upon stop command, and the next start of the internal combustion engine 2 is awaited. Hereinbelow, the details of the lock operation corresponding to the rotational phase upon stop the command will be described.

Figure 14:
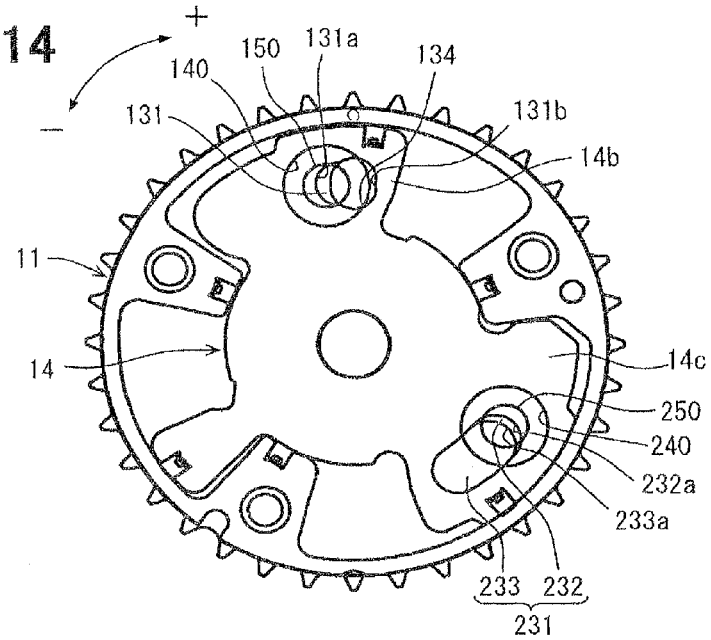
FIG. 14 is a plane view showing another operation state.

(I-1) When the rotational phase at the time of stop command is the full retard phase in FIG. 14, the vane rotor 14 rotates relatively to the housing 11 in the advance direction by the negative torque as variable torque and the restoring force of the urging member 120, and thereby the rotational phase changes in the advance direction. When the rotational phase comes to the first regulation phase in FIG. 11 by the phase shift in the advance direction, the first main regulation member 150 moves in the insertion direction X by the first main restoring force of the first main resilient member 170, and thereby the first main regulation member 150 is inserted into the first regulation recess part 131. As a result, the phase shift in the retard direction from the first regulation phase is regulated. Further, when the rotational phase comes to the second regulation phase in FIG. 15 by the phase shift in the advance direction, the second main regulation member 250 is inserted in the shallow bottom part 232 of the second regulation recess part 231 by the second main restoring force of the second main resilient member 270. As a result, the phase shift in the retard direction from the second regulation phase is regulated. Further, when the rotational phase comes to the third regulation phase in FIG. 16 with the phase shift in the advance direction, the second main regulation member 250 is inserted in the deep bottom part 233 of the second regulation recess part 231 with the second main restoring force of the second main resilient member 270, to regulate the phase shift in the retard direction from the third regulation phase.

Thereafter, when the rotational phase comes to the lock phase in FIG. 10 with further phase shift in the advance direction, the first main regulation member 150 is stopped by the regulation stopper 131*b* at the advance end of the first regulation recess part 131. At this time, the first main regulation member 150 pressed against the regulation stopper 131*b* by the restoring force of the urging member 120 is urged by the first main restoring force of the first main resilient member 170 as shown in FIG. 8, to be insert-engaged with the lock recess part 134 through the first regulation recess part 131. As a result, the rotational phase is regulated to the lock phase, and the lock state is established.

(I-2) When the rotational phase upon stop command is between the full retard phase and the lock phase, or the lock phase, an operation similar to the above-described (I-1) is started from a state corresponding to the rotational phase upon the stop command. Accordingly, also in this case, the rotational phase is regulated to the lock phase and the lock state is established.

Figure 17:
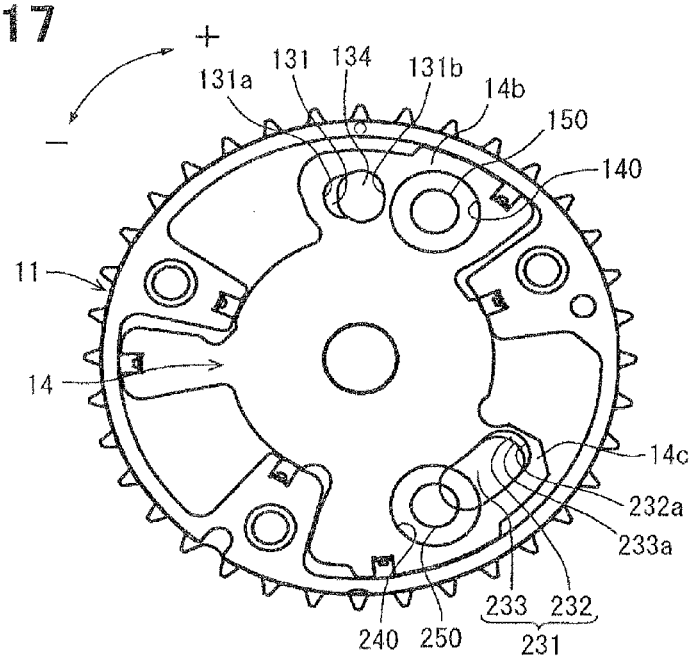
FIG. 17 is a plane view showing another operation state.

(I-3) When the rotational phase upon stop command is the full advance phase in FIG. 17, the second main regulation member 250 is inserted in the deep bottom part 233 of the second regulation recess part 231 by the second main restoring force of the second main resilient member 270. In the above state, in the present embodiment, where the application of the pressing by the restoring force of the urging member 120 is limited when the rotational phase is on the advance side of the lock phase, the rotational phase gradually shifts in the retard direction, in which the average torque Tave of the variable torque is applied. When the rotational phase comes to the lock phase in FIG. 10, as the first main regulation member 150 is inserted sequentially in the first regulation recess part 131 and the lock recess part 134 by the first main restoring force of the first main resilient member 170, the rotational phase is regulated to the lock phase and the lock state is established in the above case.

(I-4) When the rotational phase upon stop command is between the lock phase and the full advance phase, an operation corresponding to the above-described (I-3) is started from a state corresponding to the rotational phase upon stop command. Accordingly, also in this case, the rotational phase is regulated to the lock phase and the lock state is established.

(II) After the normal stop, when the cranking is performed to start the internal combustion engine 2 in response to a start command such as turn-on of the ignition switch, the control circuit 90 controls energization to the phase control valve 80 to communicate the supply passage 76 with the advance passage 72. At this time, the oil from the pump 4 is introduced through the passages 76 and 72 to the advance chambers 52 to 54. Further, upon start of the internal combustion engine 2 in response to the start command after the normal stop, the control circuit 90 controls energization to the driving control valve 310 to communicate the drain passage 304 with the driving passage 300. At this time, the oil is not introduced to the operation chambers 146 and 246, and the driving force to drive the first and second sub regulation members 152 and 252, is kept removed.

As a result, the final state in the above (I), i.e., the state, where the first and second main regulation members 150 and 250 are respectively inserted in the recess parts 134 and 231 with the restoring forces of the first and second main resilient members 170 and 270, as shown in FIGS. 8 and 18, is continued. Note that especially during the cranking until the internal combustion engine 2 becomes self-sustaining, and thereby completing the starting of the engine 2, the pressure of the oil from the pump 4 is low. Accordingly, even when the oil arrives at the operation chambers 146 and 246 due to some abnormality, the state of the respective main regulation members 150 and 250 inserted in the recess parts 134 and 231 can be maintained. Accordingly, it is possible to lock the rotational phase to the lock phase suitable for starting of the internal combustion engine 2 and provide predetermined startability.

(III) After the completion of the starting, the control circuit 90 controls energization to the driving control valve 310 to communicate the branch passage 302 from the supply passage 76 with the driving passage 300. At this time, as the pressure-increased oil is introduced through the passages 76, 302, 300, 145, and 245 to the operation chambers 146 and 246, the driving force to drive the first and second sub regulation members 152 and 252 occurs.

As a result, the first and second main regulation members 150 and 250 also move in the escape direction Y by movement of the first and second sub regulation members 152 and 252 in the escape direction Y and engagement between the engagement part 256 and the projection member 251. With this arrangement, as the first main regulation member 150 escapes from the lock recess part 134 and the first regulation recess part 131, and the second main regulation member 250 escapes from the second regulation recess part 231, the rotational phase is released from the regulation and the rotational phase is allowed to be changeable to any position. Accordingly, thereafter, flexible valve timing control can be realized by control of the energization to the phase control valve 80 to introduce the oil from the pump 4 to the advance chambers 52 to 54 or the retard chambers 56 to 58 by the control circuit 90.

Next, the relation between the pressure of oil in the operation chambers 146 and 246 and the operations of the first and second sub regulation members 152 and 252 and the like will be described. When the pressure-increased oil is introduced through the first and second regulation passages 145 and 245 to the operation chambers 146 and 246, the pressure reception parts 154 and 254 receive pressure from the oil in the operation chambers 146 and 246, and the first and second sub regulation members 152 and 252 move in the escape direction Y against the resilient forces of the first and second sub resilient members 172 and 272. In accordance with the movement in the escape direction Y, the engagement parts 156 and 256 of the first and second sub regulation members 152 and 252 are engaged with the projection members 151 and 251 of the first and second main regulation members 150 and 250, and the first and second sub regulation members 152 and 252 move the first and second main regulation members 150 and 250 in the escape direction Y. Accordingly, the first and second main regulation members 150 and 250 escape from the first and second regulation recess parts 131 and 231, and the phase is released from the regulation.

Next, when the pressure of the oil is lowered, the pressure applied to the pressure reception parts 154 and 254 is reduced and the resilient forces of the first and second sub resilient members 172 and 272 exceeds the pressure. Accordingly, the oil starts to flow to the first and second regulation passages 145 and 245 in accordance with the movement of the first and second sub regulation members 152 and 252 in the insertion direction X, then the first and second main regulation members 150 and 250 move in the insertion direction X into contact with the inner surface 132 of the cover member 13. In this manner, in the state, where the first and second main regulation members 150 and 250 are in contact with the inner surface 132 of the cover member 13 and movement in the insertion direction X is regulated, only the movement of the first and second sub regulation members 152 and 252 in the insertion direction X is advanced with the resilient forces of the first and second resilient members 172 and 272, and the oil further flows to the first and second regulation passages 145 and 245, to promote discharge from the operation chambers 146 and 246. When the oil pressure is further reduced, the pressure reception parts 154 and 254 is brought into press-contact with the end surface 143 that faces the sleeve 141*a* and 241*a* and the volumes of the operation chambers 146 and 246 become the minimum volumes. Accordingly, the oil is completely discharged.

(Fail Safe Operation)

Next, a fail safe operation upon abnormal stop of the internal combustion engine 2 will be described.

(i) Upon abnormal stop, when the internal combustion engine 2 instantly stops and is locked due to clutch engagement abnormality or the like, energization from the control circuit 90 to the phase control valve 80 is cut, and the supply passage 76 communicates with the advance passage 72. At this time, as the pressure of the oil introduced from the pump 4 through the passage 76 and 72 to the advance chambers 52 to 54 is suddenly lowered, the force acting on the vane rotor 14 by the pressure is removed, and the rotational phase is held as the phase upon abnormal stop (instant stop) due to the locked state of the internal combustion engine 2.

Further, upon abnormal stop of the internal combustion engine 2, energization from the control circuit 90 to the driving control valve 310 is also cut, and the drain passage 304 communicates with the driving passage 300. Accordingly, the driving force to drive the first and second sub regulation members 152 and 252 is removed. As a result, in correspondence with the above-described (I) upon normal operation, the first and second sub regulation members 152 and 252 bring the pressure reception parts 154 and 254 into contact with the end surfaces 143 and 243 of the small diameter support parts 141 and 241, and the first and second main regulation members 150 and 250 are fixedly positioned in a moved position corresponding to the rotational phase upon abnormal stop.

Accordingly, thereafter, as the apparatus enters an operation state corresponding to the rotational phase upon abnormal stop, the details of this state will be described hereinbelow.

(i-1) When the rotational phase upon abnormal stop is different from the regulation phase, i.e., when the rotational phase is out of the region of the regulation phase including the full retard phase in FIG. 14, the first and second main regulation members 150 and 250 come into contact with the inner surface 132 of the cover member 13 as shown in FIGS. 12 and 20 with the restoring forces of the first and second main resilient members 170 and 270. With this contact, the movement of the first and second main regulation members 150 and 250 in the insertion direction X from the inner surface 132 of the cover member 13 is regulated in a state, where the projection members 151 and 251 are away from the engagement parts 156 and 256 of the first and second sub regulation members 152 and 252. Accordingly, because the first and second main regulation members 250 cannot be inserted into the recess parts 131, 134 and 231 recessed from the inner surface 132 of the cover member 13, locking to the lock phase is not realized and the next start operation of the internal combustion engine 2 is waited.

(i-2) When the rotational phase upon abnormal stop is the first regulation phase or between the first regulation phase and the lock phase, as a state corresponding to the rotational phase upon abnormal stop in the above-described normal operation state (I-1), the first main regulation member 150 is inserted in the first regulation recess part 131 by the restoring force of the first main resilient member 170. On the other hand, the second main regulation member 250 is in contact with the inner surface 132 of the cover member 13 due to the restoring force of the second main resilient member 270. With these states, the locking to the lock phase is not realized, and the next start of the internal combustion engine 2 is waited.

(i-3) When the rotational phase upon abnormal stop is the lock phase, because the first main regulation member 150 is insertable into and is engageable with the lock recess part 134 by the restoring force of the first main resilient member 170, locking to the lock phase is realized, and the next start operation of the internal combustion engine 2 is waited.

(i-4) When the rotational phase upon abnormal stop is the full retard phase in FIG. 17 or between the lock phase and the full advance phase, the drive unit 10 stops in a state corresponding to the rotational phase upon abnormal stop in the above-described normal operations (I-3) or (I-4). Accordingly, locking to the lock phase is not realized and the next start of the internal combustion engine 2 is waited.

(ii) When the internal combustion engine 2 is started in response to a start command after abnormal stop, the control circuit 90 controls energization to the phase control valve 80 to introduce the oil from the pump 4 to the advance chambers 52 to 54. At the same time, the control circuit 90 controls energization to the drive control valve 310 to maintain the state, where the driving force to drive the first and second sub regulation members 152 and 252 is removed. As a result of the control, the rotational phase is controlled in accordance with a rotational phase upon start command substantially corresponding to the rotational phase upon abnormal stop before completion of start of the internal combustion engine 2. Hereinbelow, the details of the control in accordance with the rotational phase upon start command will be described.

(ii-1) When the rotational phase upon start command is different from the regulation phase, i.e., when the rotational phase is out of the region of the regulation phase including the full retard phase in FIG. 14, with the negative torque as variable torque and the restoring force of the urging member 120, the vane rotor 14 relatively rotates to the advance side with respect to the housing 11, then the rotational phase varies to the advance side in accordance with the rotation. As a result, in accordance with the above-described (I-1) upon normal operation, the first and second main regulation members 150 and 250 are sequentially inserted in the first and second regulation recess parts 131 and 231, and further, the first main regulation member 150 is insert-engaged with the lock recess part 134.

Even though the oil remains in the operation chambers 146 and 246 at this time, the pressure of the remaining oil does not substantially act on the first and second main regulation members 150 and 250. Accordingly, it is possible to quickly drive the first and second main regulation members 150 and 250 toward the engagement parts 156 and 256 of the first and second sub regulation members 152 and 252, which engagement parts 156 and 256 are away from the projection members 151 and 251, and thereby to quickly insert the first and second main regulation members 150 and 250 in the recess parts 131, 134, and 231, as shown in FIGS. 12 and 20.

Note that the side of the first and second main regulation members 150 and 250 adjacent the recess parts 131, 134 and 231, i.e., adjacent the cover member 13, is atmospherically opened with the atmospheric holes 136 and 236 communicating with the recess parts 131 and 231 at least at the lock phase. Further, the other side of the first and second main regulation members 150 and 250 opposite from the cover member 13 is atmospherically opened through the atmospheric holes 136 and 236 communicated via the through holes 149 and 249 at least at the lock phase.

In other words, a front chamber between the first main regulation member 150 and the recess part 131 can be opened to atmosphere through the atmospheric holes 136 and 137. Further, a front chamber between the second main regulation member 250 and the recess part 231 can be opened to atmosphere with the atmospheric holes 236 and 237. Further, a rear chamber, i.e. the communication chamber 148, between the first main regulation member 150 and the bottom surface of the first receiving part 140 opposite from the recess part 131 can be opened to atmosphere with the atmospheric holes 136 and 137. Further, a rear chamber, i.e. the communication chamber 248, between the second main regulation member 250 and the bottom surface of the second accommodation member 240 opposite from the recess part 231 can be opened to atmosphere with the atmospheric holes 236 and 237. The above atmospherically-opened states are provided when it is necessary to move the main regulation members 150 and 250 in the insertion direction X. For example, the atmospherically-opened state can be provided at least at the lock phase. Further, the atmospherically-opened state can be provided at least in the region of the regulation phase.

According to these arrangements, it is possible to reduce moving resistance applied to the cover member 13 side or the opposite side of the first and second main regulation members 150 and 250, e.g., resistance due to occurrence of negative pressure or resistance due to leaked oil and to increase insertion speed of the main regulation members 150 and 250.

Further, from another viewpoint, the pressure difference across the first and second main regulation members 150 and 250 can be suppressed by the through holes 159 and 259. With this arrangement, the reduction of moving speed of the first and second main regulation members 150 and 250 due to the pressure of the front chamber and the rear chamber can be suppressed. Further, as the cover member 13 side and the opposite side of the first and second main regulation members 150 and 250 mutually communicate through the through holes 159 and 259, the degradation of atmospherically-opened state due to dogging of the atmospheric holes 136, 236, 137 and 237 is suppressed. Accordingly, the moving resistance, which influences the insertion speed of the first and second main regulation members 150 and 250, is reliably reduced.

In addition, in the state upon start command where the first and second sub regulation members 152 and 252 bring the pressure reception parts 154 and 254 into contact with the end surfaces 143 and 243 of the small diameter support parts 141 and 241, the first and second communication passages 158 and 258 are formed as shown in FIGS. 8, 9, 12, and 18 to 20. Note that as the atmospheric holes 137 and 237 communicate with the advance communication holes 147 and 247, communicating with the advance chambers 52 and 53, the first and second communication chambers 158 and 258 atmospherically open the advance chambers 52 and 53. Further, in the first and second communication passages 158 and 258, the atmospheric flow resistance can be lower than the oil flow resistance by the throttle operations of the peripheral grooves 157 and 257 in the middle of the passages. With these operations, it is possible to suppress occurrence of negative pressure, caused by volume expansion of the advance chambers 52 and 53 with the negative torque as variable torque and the restoring force of the urging member 120, by introduction of atmosphere into these advance chambers 52 and 53. Accordingly, the reduction of shifting speed of the rotational phase can be suppressed.

As described above, even though the rotational phase is different from the regulation phase upon start command, the rotational phase can be quickly returned to the lock phase most suitable to starting at the regulation phase. As a result, the degradation of startability can be suppressed.

(ii-2) When the rotational phase upon start command is the first regulation phase in FIG. 11 or between the first regulation phase and the lock phase, an operation corresponding to the above-described (ii-1) is started from a state corresponding to the rotational phase upon start command. Accordingly, in this case, it is also possible to return the rotational phase to the lock phase and suppress the degradation of startability.

(ii-3) When the rotational phase upon start command is the lock phase in FIG. 10, it is possible to realize a normal operation corresponding to the above-described (II), and provide predetermined startability.

(ii-4) When the rotational phase upon start command is the full advance phase in FIG. 17 or between the lock phase and the full advance phase, the rotational phase is controlled to the full advance phase by introduction of the oil to the advance chambers 52 to 54. Accordingly, in this case, as the start of the internal combustion engine 2 is realized in the full advance phase as the regulation phase, it is possible to suppress the degradation of the startability.

(iii) After the completion of this start, it is possible to realize flexible valve timing control by introducing the oil from the pump 4 to the advance chambers 52 to 54 or the retard chambers 56 to 58 with a normal operation corresponding to the above-described (III). Further, at this time, the first and second sub regulation members 152 and 252 move to the interruption position in the escape direction Y as shown in FIGS. 13 and 21, to prohibit communication between the peripheral grooves 157 and 257 and the advance communication holes 147 and 247 forming the first and second communication passages 158 and 258. According to this arrangement leakage of oil in the advance chambers 52 and 53 communicating with the advance communication holes 147 and 247 through the first and second communication passages 158 and 258 to the outside can be suppressed. Accordingly, it is also possible to improve the responsibility of the valve timing control.

As described above, according to the first embodiment, it is possible to suppress the degradation of startability upon start of the internal combustion engine 2. Further, it is possible to suppress the degradation of the startability regardless of environmental temperature. Further, it is possible to realize flexible valve timing control after the completion of start of the internal combustion engine 2.

Note that in the above-described first embodiment, the first regulation recess part 131, the second regulation recess part 231 or the lock recess part 134 provides a "recess part". The first main regulation member 150 or the second main regulation member 250 provides a "main regulation member". The first main regulation member 150 or the second main regulation member 250 may also be referred to as a coupling member to provide a mechanically coupled state and a mechanically uncoupled state. The first sub regulation member 152 or the second sub regulation member 252 provides a "sub regulation member". The first sub regulation member 152 or the second sub regulation member 252 may also be referred to as a fluid-like piston member to move upon reception of pressure of hydraulic fluid. The piston member moves the coupling member having a main regulation member only in the escape direction. The piston member and the coupling member having the main regulation member are mechanically connected with a unidirectional interlock mechanism. The unidirectional interlock mechanism interlocks the piston member with the coupling member only regarding the escape direction. The unidirectional interlock mechanism allows movement of the piston member away from the coupling member regarding the insertion direction. As a result, when the piston member has moved away from the coupling member regarding the insertion direction, the coupling member, without being regulated with the piston member, can move in the insertion direction. The unidirectional interlock mechanism can be provided by the engagement mechanisms 151, 251, 154 and 254 engaged in only one direction. The first main resilient member 170 or the second main resilient member 270 provides a "main resilient member". The first sub resilient member 172 or the second sub resilient member 272 provides a "sub resilient member". The atmospheric hole 136 or the atmospheric hole 236 provides an "atmospheric hole to open the recess part side to atmosphere". The atmospheric hole 137 or the atmospheric hole 237 provides an "atmospheric hole to open the other side opposite from the recess part to atmosphere" and an "opening hole". The first advance communication hole 147 or the second advance communication hole 247 provides a "communication hole". The peripheral groove 157 or the peripheral groove 257 provides a "throttle member". The small diameter support part 141 or the small diameter support part 241, i.e. the sleeve 141*a* or the sleeve 241*a* provides a "support part". The first sub regulation member 152 or the second sub regulation member 252 provides a valve mechanism to disconnect the communication passages 158 and 258. The sub regulation members 152 and 252 are movable to the interruption position, at which the sub regulation members 152 and 252 prohibit communication between the opening hole and the communication hole, and are movable to the communication position, at which the sub regulation members 152 and 252 allow the communication between the opening hole and the communication hole. The communication position is displaced from the interruption position in the insertion direction. In a regulated state, the sub regulation member is positioned in the communication position. In a state, where the sub regulation member and the main regulation member are completely released from regulation, the sub regulation member is positioned in the interruption position. When a force in the insertion direction acts on the main regulation member, the sub regulation member is positioned in the communication position.

Second Embodiment

As shown in FIGS. 22 to 25, the second embodiment of the present invention is a modification of the first embodiment. In the second embodiment, peripheral grooves 2157 and 2257 formed in first and second sub regulation members 2152 and 2252 are not opened to the space located on the side of the first and second sub regulation members 2152 and 2252 opposite from the cover member 13. As a result, communication between the peripheral grooves 2157 and 2257 and the communication chambers 148 and 248 is substantially prohibited. Further, communication between the first and second advance communication holes 147 and 247 and the corresponding communication chambers 148 and 248 is substantially prohibited by the first and second sub regulation members 2152 and 2252 at any position. Further, communication between first and second retard communication holes 2147 and 2247 and the corresponding communication chambers 148 and 248 is substantially prohibited by the first and second sub regulation members 2152 and 2252 at any position.

Figure 22:
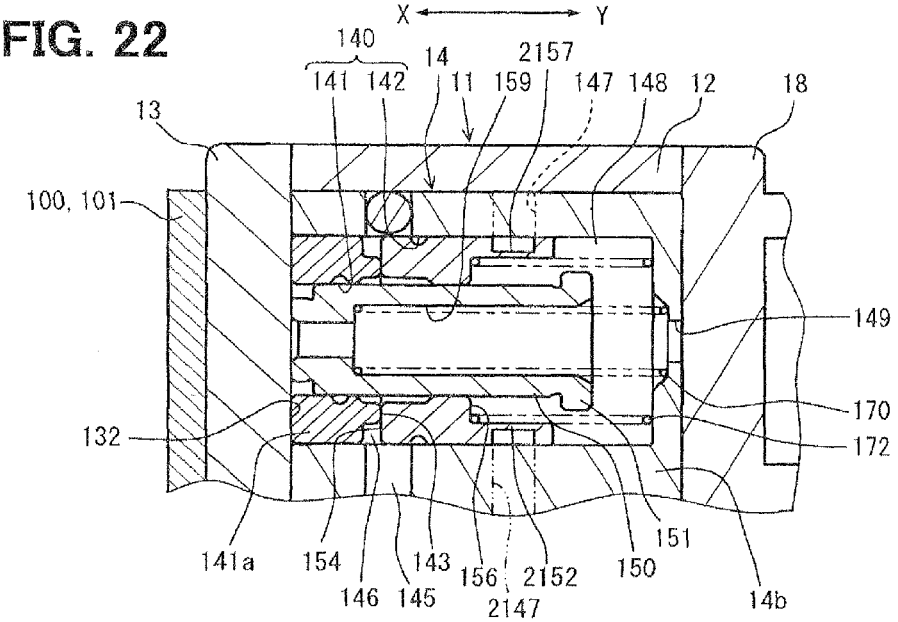
FIG. 22 is an enlarged cross-sectional view showing the valve timing control apparatus according to a second embodiment of the present invention.
Figure 23:
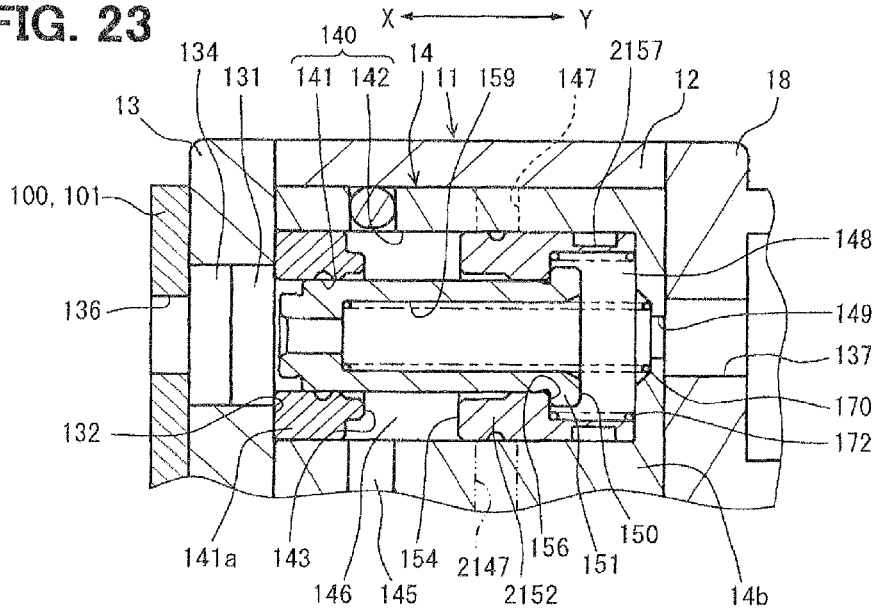
FIG. 23 is an enlarged cross-sectional view showing another operation state.
Figure 24:
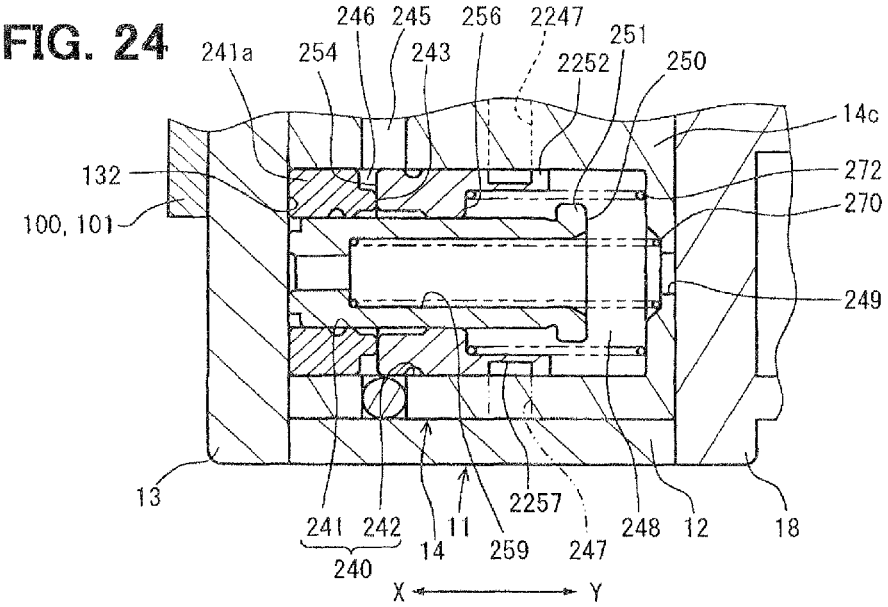
FIG. 24 is an enlarged cross-sectional view of the valve timing control apparatus according to the second embodiment of the present invention.
Figure 25:
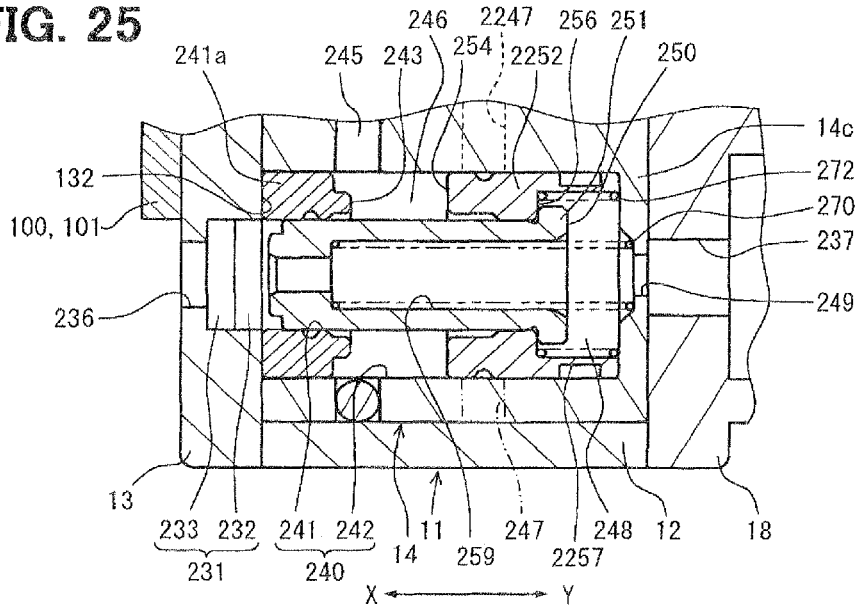
FIG. 25 is an enlarged cross-sectional view showing another operation state.

In the above structure, the first and second sub regulation members 2152 and 2252 move to the interruption position in the escape direction Y as shown in FIGS. 23 and 25, to prohibit the communication between the corresponding advance communication holes 147 and 247 and the retard communication holes 2147 and 2247. On the other hand, the first and second sub regulation members 2152 and 2252 move in the insertion direction X from the interruption position as shown in FIGS. 22 and 24, to communicate the corresponding advance communication holes 147 and 247 with the retard communication holes 2147 and 2247 with the peripheral grooves 2157 and 2257.

In the second embodiment, when the rotational phase upon abnormal stop and upon start command is different from the regulation phase, the first and second sub regulation members 2152 and 2252 bring the pressure reception parts 154 and 254 into contact with the end surfaces 143 and 243 of the small diameter support parts 141 and 241 as shown in FIGS. 22 and 24. At this time, as the advance communication holes 147 and 247 communicate with the retard communication holes 2147 and 2247 with the peripheral grooves 2157 and 2257 of the first and second sub regulation members 2152 and 2252, even when the oil remains in the retard chambers 56 and 57, the remaining oil can be discharged to the advance chambers 52 and 53. According to the arrangement, when the internal combustion engine 2 is started while the rotational phase is shifted in the advance direction and the first and second main regulation members 150 and 250 are inserted in the recess parts 131, 134 and 231, it is possible to suppress degradation of shifting speed of the rotational phase due to the remaining oil in the retard chambers 56 and 57. Accordingly, in the second embodiment, it is also possible to quickly return the rotational phase to the lock phase that is most suitable to starting and to suppress degradation of startability.

In addition, in the second embodiment, after the completion of start of the internal combustion engine 2, the first and second sub regulation members 2152 and 2252 move to the interruption position in the escape direction Y as shown in FIGS. 23 and 25, to prohibit communication between the advance communication holes 147 and 247 and the retard communication holes 2147 and 2247. According to this arrangement, leakage of oil from one of the advance chambers 52 and 53 and the retard chambers 56 and 57 to the other chambers can be suppressed. Accordingly, it is possible to improve responsibility of valve timing control.

Note that in the above-described second embodiment, the first sub regulation member 2152 or the second sub regulation member 2252 provides a "sub regulation member". The first advance communication hole 147 or the second advance communication hole 247 provides an "advance communication hole". The first retard communication hole 2147 or the second retard communication hole 2247 provides a "retard communication hole".

Third Embodiment

As shown in FIGS. 26 to 29, a third embodiment of the present invention is a modification of the second embodiment. In the third embodiment, atmospheric holes 3137 and 32367 which are always atmospherically opened and which always communicate with the communication chambers 148 and 248 respectively communicate with the first and second through holes 149 and 249 in the entire region of the rotational phase including the lock phase.

Further, the first and second sub regulation members 3152 and 3252 of the third embodiment form multiple first and second ventilation passages 3160 and 3260 in a cylindrical hole shape through the bottoms of the peripheral grooves 2157 and 2257 in a radial direction to communicate the peripheral grooves 2157 and 2257 with the communication chambers 148 and 248 respectively in a circumferential direction. Note that the first and second advance communication holes 147 and 247 and the first and second retard communication holes 2147 and 2247 face and communicate with the corresponding peripheral grooves 2157 and 2257 at the communication position as shown in FIGS. 26 and 28, and the communication position is displaced from the interruption position in the insertion direction X as shown in FIGS. 27 and 29.

Figure 26:
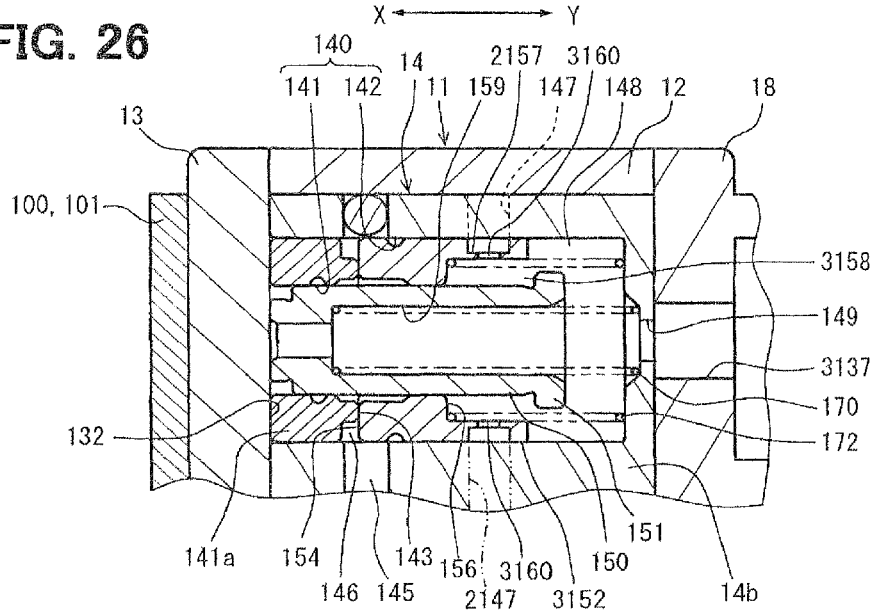
FIG. 26 is an enlarged cross-sectional view of the valve timing control apparatus according to a third embodiment of the present invention.
Figure 27:
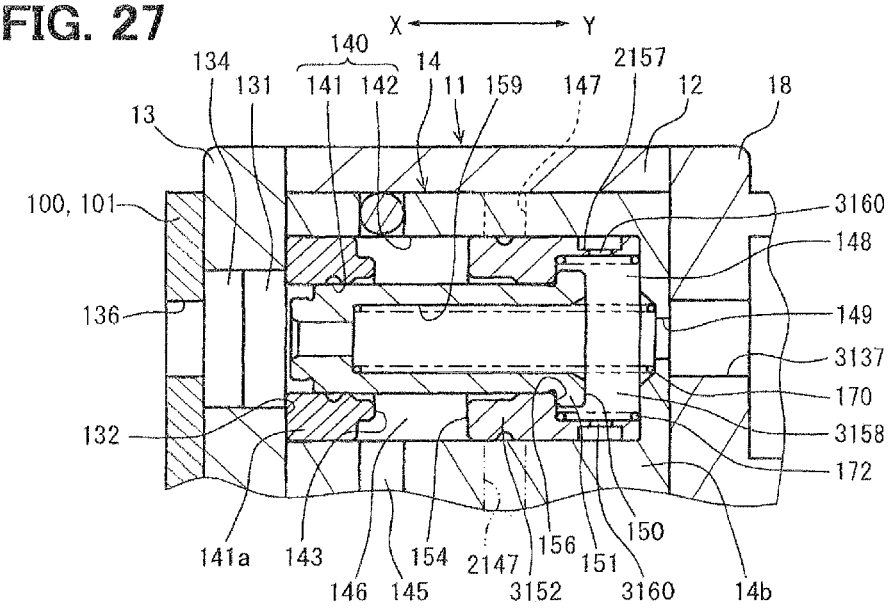
FIG. 27 is an enlarged cross-sectional view showing another operation state.
Figure 28:
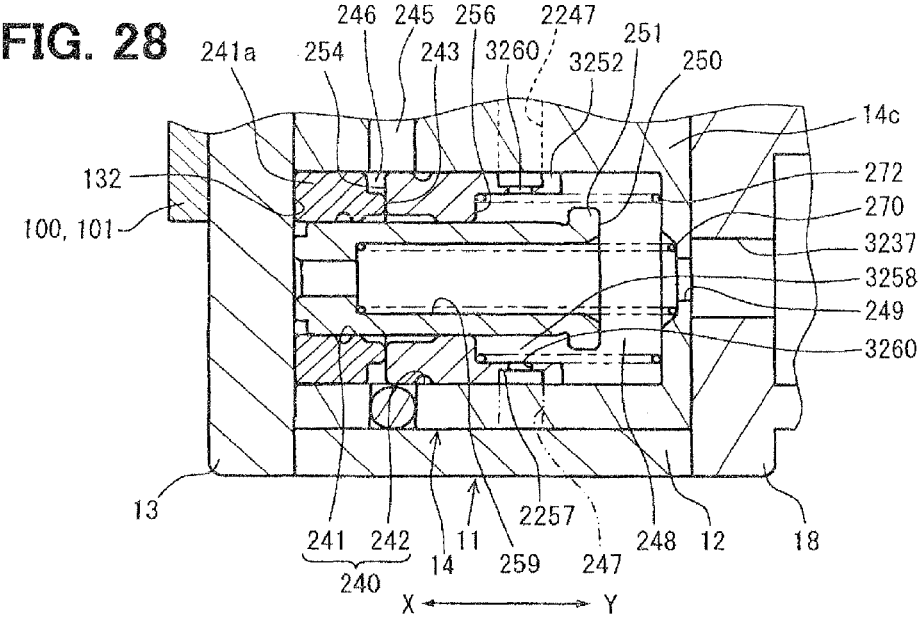
FIG. 28 is an enlarged cross-sectional view of the valve timing control apparatus according to the third embodiment of the present invention.
Figure 29:
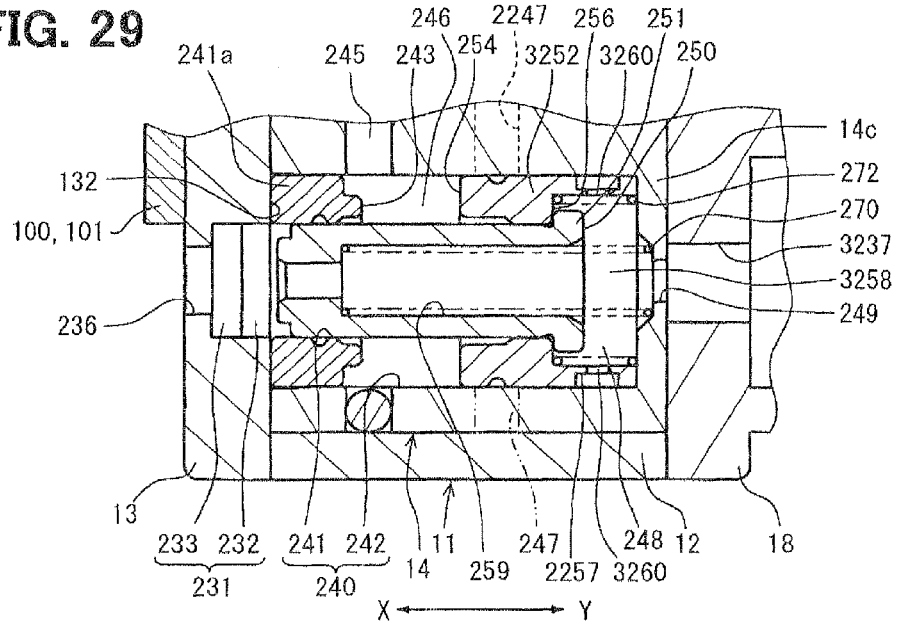
FIG. 29 is an enlarged cross-sectional view showing another operation state.

In this structure, the first and second sub regulation members 3152 and 3252 move to the interruption position in the escape direction Y as shown in FIGS. 27 and 29, to prohibit communication between the corresponding advance communication holes 147 and 247 and the retard communication holes 2147 and 2247 and communication with the atmospheric holes 3137 and 3237 between them. Further, on the other hand, the first and second sub regulation members 3152 and 3252 move in the insertion direction X from the interruption position as shown in FIGS. 26 and 28, to communicate between the corresponding advance communication holes 147 and 247 and the retard communication holes 2147 and 2247, with the peripheral grooves 2157 and 2257, and communicate between them with the atmospheric holes 3137 and 3237, with the first and second ventilation passages 3160 and 3260.

In this manner, in the third embodiment, first and second communication passages 3158 and 3258 are formed from the atmospheric holes 3137 and 3237 through the first and second through holes 149 and 249, the communication chambers 148 and 248, the first and second ventilation passages 3160 and 3260, and the peripheral grooves 2157 and 2257, to the first and second advance communication holes 147 and 247 and the first and second retard communication holes 2147 and 2247. Then, in the first and second communication passages 3158 and 3258, the inner diameters of the first and second ventilation passages 3160 and 3260 are controlled so as to reduce the flow area of the first and second ventilation passages 3160 and 3260 to reduce the atmospheric flow resistance to a lower level than the oil flow resistance.

In the above-described third embodiment, when the rotational phase upon abnormal stop and start command is different from the regulation phase, the first and second sub regulation members 3152 and 3252 bring the pressure reception parts 154 and 254 into contact with the end surfaces 143 and 243 of the small diameter support parts 141 and 241 as shown in FIGS. 26 and 28. At this time, as the advance communication holes 147 and 247 and the retard communication holes 2147 and 2247 communicate with each other with the peripheral grooves 2157 and 2257 of the first and second sub regulation members 3152 and 3252, even when the oil remains in the retard chambers 56 and 57, the remaining oil can be discharged to the advance chambers 52 and 53. Further, at this time, as the advance communication holes 147 and 247 and the retard communication holes 2147 and 2247 communicate with the atmospheric holes 3137 and 3237 with the peripheral grooves 2157 and 2257 and the first and second ventilation passages 3160 and 3260 having a throttle operation, even in a state, where the oil is moved with difficulty due to high viscosity (for example, in oil degradation state or low temperature state), atmosphere introduction to the advance chambers 52 and 53 and the retard chambers 56 and 57 can be facilitated. According to these arrangements, when the internal combustion engine 2 is started while the rotational phase is shifted in the advance direction to insert the first and second main regulation members 150 and 250 in the recess parts 131, 134 and 231, it is possible to suppress the degradation of shifting speed of the rotational phase due to the remaining oil in the retard chambers 56 and 57 and occurrence of load in the advance chambers 52 and 53. Accordingly, according to the third embodiment, it is possible to quickly return the rotational phase to the lock phase most suitable to starting and suppress the degradation of startability.

In addition, in the third embodiment, after the completion of start of the internal combustion engine 2, the first and second sub regulation members 3152 and 3252 move to the interruption position in the escape direction Y as shown in FIGS. 27 and 29, to prohibit communication between the advance communication holes 147 and 247 and the retard communication holes 2147 and 2247 in the interrupted state, with respect to the atmospheric holes 3137 and 3237. According to this arrangement, leakage of the oil from one of the advance chambers 52 and 53 and the retard chambers 56 and 57 to the other chambers can be suppressed. Accordingly, it is possible to highly substantially improve the responsiveness of valve timing control.

Further, in addition, in the third embodiment, in the stop state of the internal combustion engine 2, the first and second sub regulation members 3152 and 3252 communicate between the advance communication holes 147 and 247 and the retard communication holes 2147 and 2247 with the atmospheric holes 3137 and 3237. According to this arrangement, after the end of running of the internal combustion engine 2, when the remaining oil in the advance chambers 52 and 53 and the retard chambers 56 and 57 is discharged by e.g. construction weight, exchange of the remaining oil with atmosphere can be facilitated. Accordingly, before start of the internal combustion engine 2, as the remaining oil itself in the retard chambers 56 and 57 is reduced, the suppression of degradation of startability by suppression of degradation of shifting speed of the rotational phase can be further improved.

Note that in the above-described third embodiment, the first sub regulation member 3152 or the second sub regulation member 3252 provides a "sub regulation member". The atmospheric hole 3137 or the atmospheric hole 3237 provides an "atmospheric hole to open the other side opposite from the recess part to atmosphere" and an "opening hole". The first ventilation passage 3160 or the second ventilation passage 3260 provides a "throttle member".

Fourth Embodiment

A fourth embodiment of the present invention shows a preferable embodiment. Further, in FIGS. 33 to 54, constituent elements having the same reference numeral as those of the constituent elements described in the above-described first to third embodiments are the same and have similar operations and effects.

Hereinbelow, operation states of a first regulation structure and a second regulation structure corresponding to the rotational phase of the vane rotor 14 will be described with reference to FIGS. 33 to 50.

Figure 39:
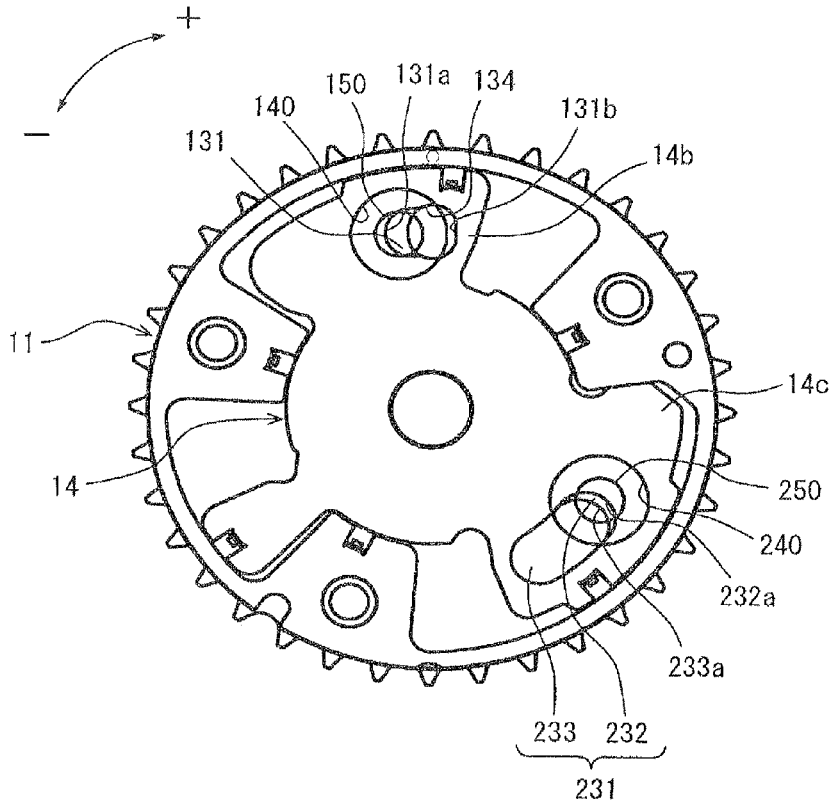
FIG. 39 is a plane view showing another operation state.
Figure 40:
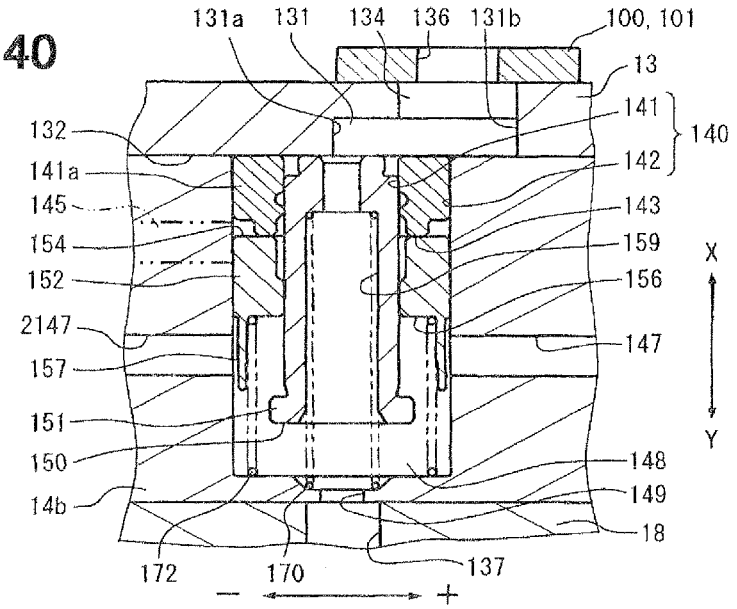
FIG. 40 is an enlarged cross-sectional view of the first regulation member shown in FIG. 39.
Figure 41:
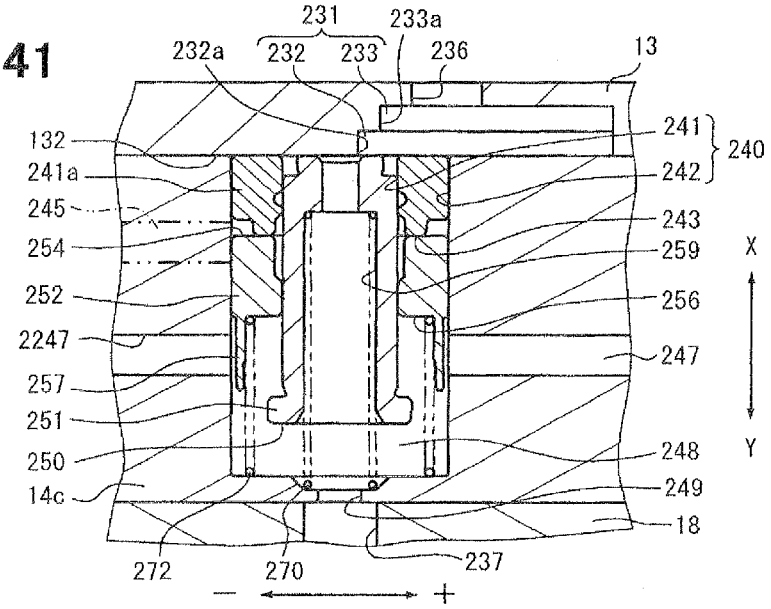
FIG. 41 is an enlarged cross-sectional view of the second regulation member shown in FIG. 39.

First, when the rotational phase is the full retard phase shown in FIG. 39, as shown in FIG. 40, as the end of the first main regulation member 150 in the insertion direction X is in a position in contact with the inner surface 132 of the cover member 13 formed on the retard side from the regulation stopper 131*a*, it is pressed in the insertion direction X with the resilient force from the first main resilient member 170 but is not inserted in the recess parts 131 and 134 recessed from the inner surface 132. Further, regarding the second regulation member 250, as shown in FIG. 41, the end in the insertion direction X is in a position in contact with the inner surface 132 of the cover member 13 formed on the retard side from the regulation stopper 232*a*, it is pressed in the insertion direction X with the resilient force of the second main resilient member 270 but is not inserted in the second regulation recess part 231 recessed from the inner surface 132.

Figure 36:
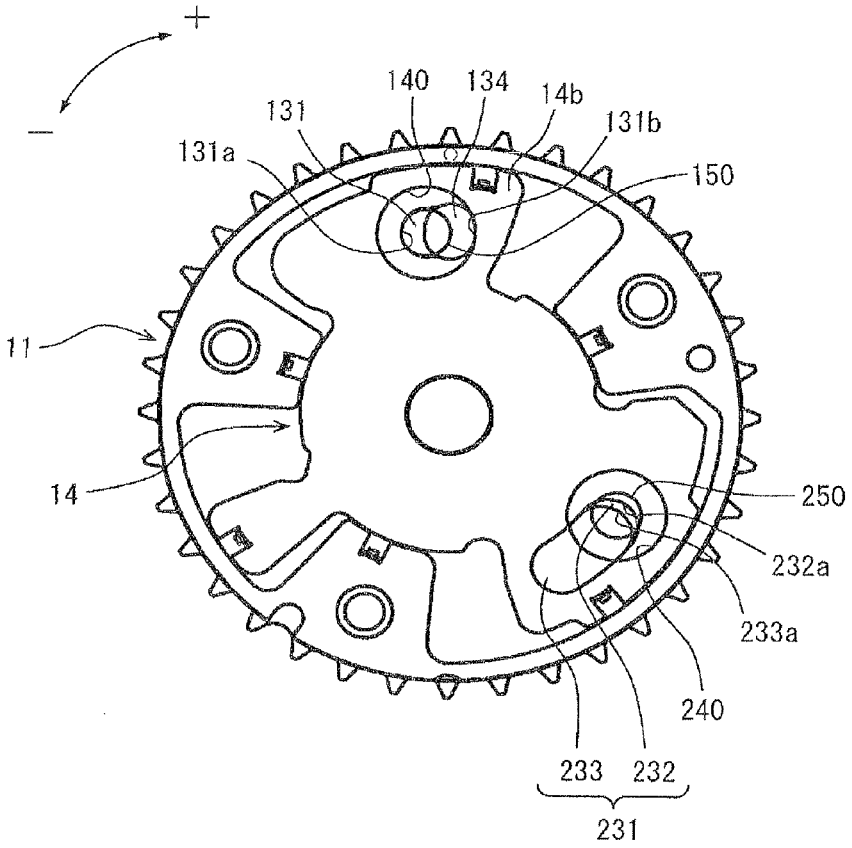
FIG. 36 is a plane view showing another operation state.
Figure 37:
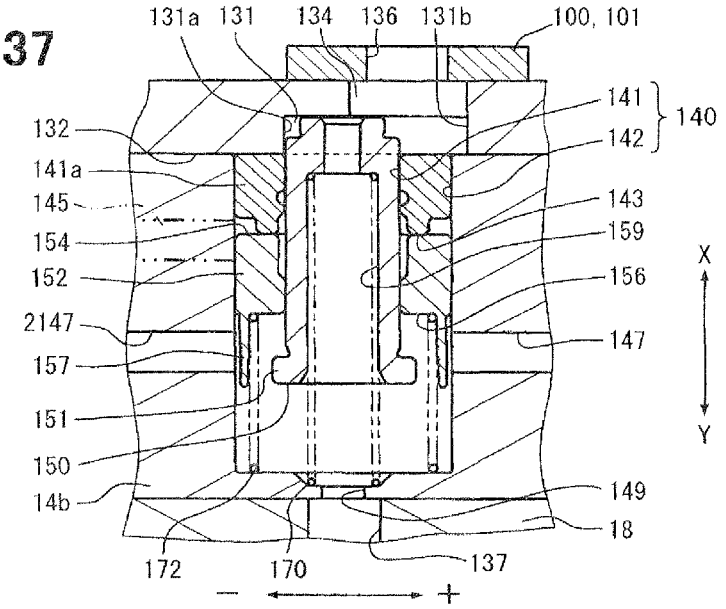
FIG. 37 is an enlarged cross-sectional view of the first regulation member shown in FIG. 36.
Figure 38:
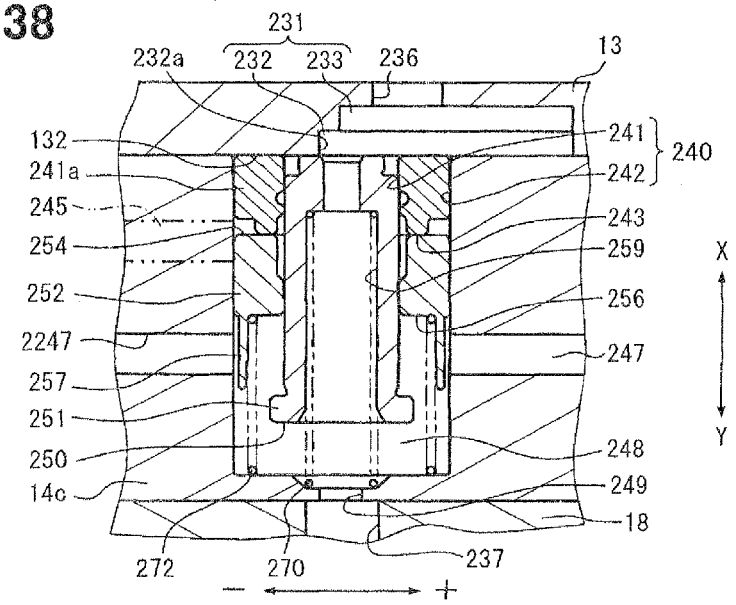
FIG. 38 is an enlarged cross-sectional view of the second regulation member shown in FIG. 36.

In this case of the full retard phase, as the vane rotor 14 relatively rotates to the advance side with respect to the housing 11 with the negative torque as variable torque and the restoring force of the urging member 120, the rotational phase varies to the advance side. With the phase shift in the advance direction, as shown in FIG. 36, when the rotational phase comes to the first regulation phase which comes first from the full retard phase toward the advance side, the entire end of the first main regulation member 150 in the insertion direction X is positioned on the advance side from the regulation stopper 131*a* as shown in FIG. 37. With this arrangement, the first main regulation member 150 moves in the insertion direction X with the first main restoring force of the first main resilient member 170 and is inserted in the first regulation recess part 131. Accordingly, the phase shift in the retard direction from the first regulation phase can be regulated. Also, a part of the end of the second main regulation member 250 in the insertion direction X is in a position in contact with the inner surface 132 of the cover member 13 formed on the retard side from the regulation stopper 232*a* as shown in FIG. 38. As a result, even when the second main regulation member 250 is urged in the insertion direction X by the resilient force from the second main resilient member 270, the second main regulation member 250 is not inserted into the shallow bottom part 232 of the second regulation recess part 231 recessed from the inner surface 132.

Figure 42:
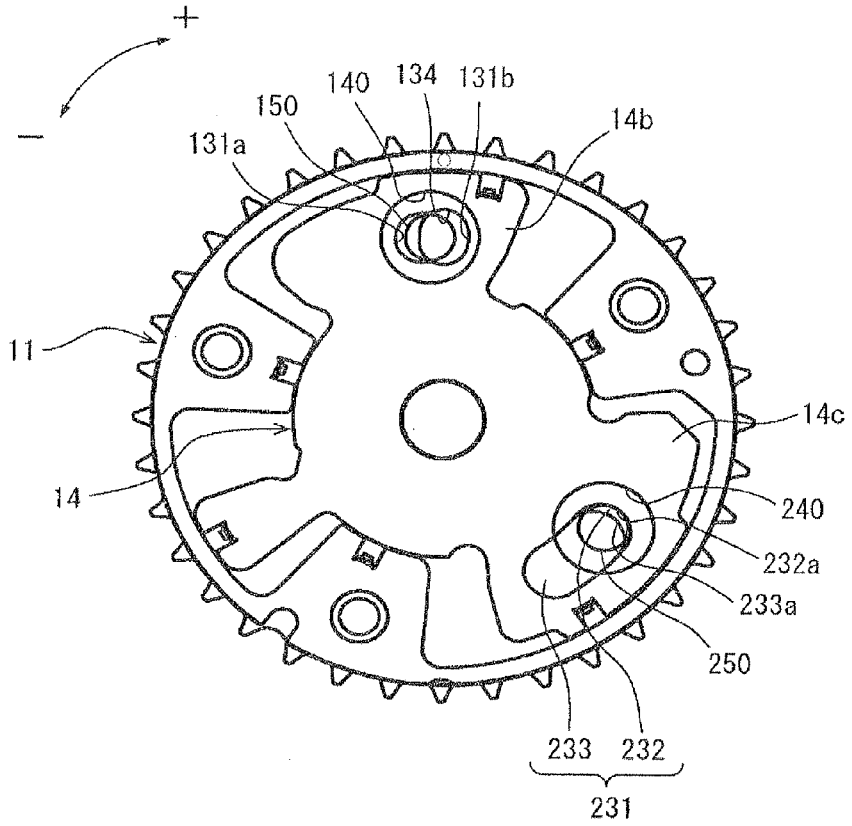
FIG. 42 is a plane view showing another operation state.
Figure 43:
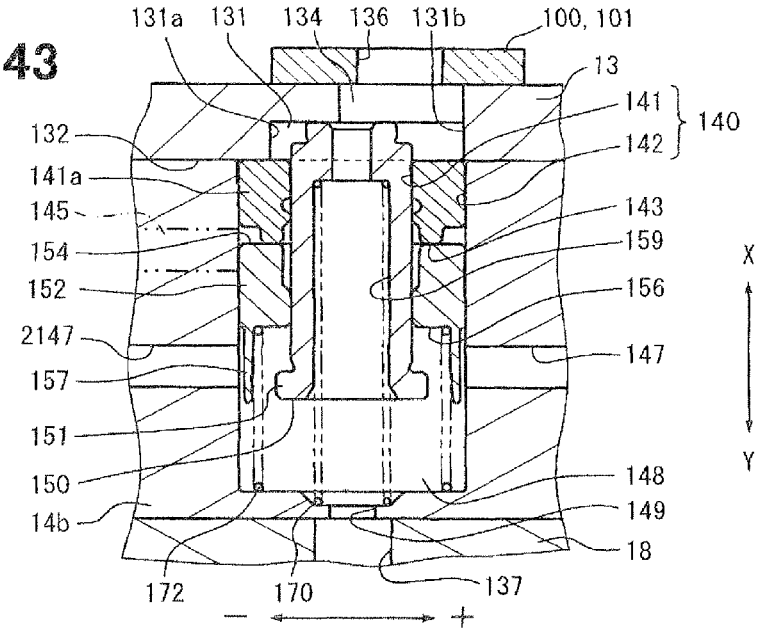
FIG. 43 is an enlarged cross-sectional view of the first regulation member shown in FIG. 42.
Figure 44:
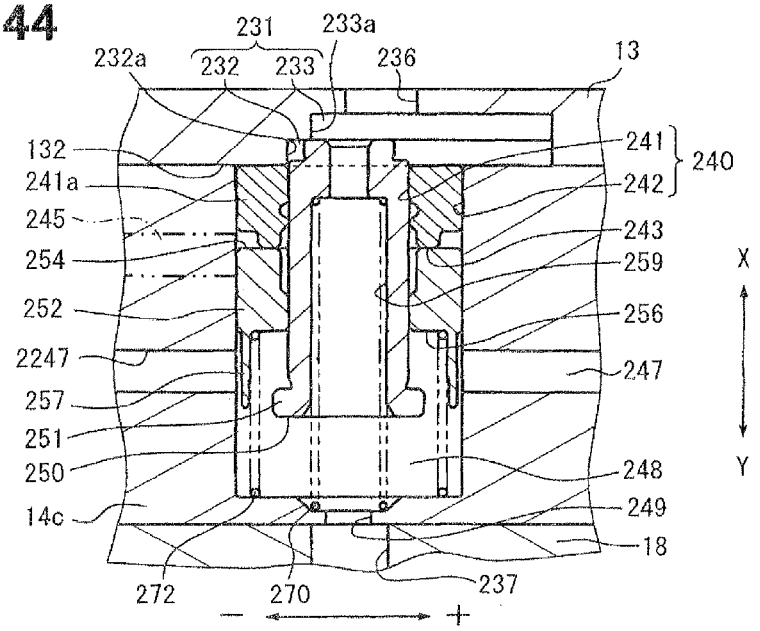
FIG. 44 is an enlarged cross-sectional view of the second regulation member shown in FIG. 42.

With this progress of phase shift from the first regulation phase to the advance side, when the rotational phase comes to the second regulation phase which comes second time from the full retard phase toward the advance side, as shown in FIG. 42, the entire end of the second main regulation member 250 in the insertion direction X is positioned on the advance side from the regulation stopper 233*a* as shown in FIG. 44. With this arrangement, the second main regulation member 250 moves in the insertion direction X with the second restoring force of the second main resilient member 270 and is inserted in the shallow bottom part 232 of the second regulation recess part 231. Accordingly, the phase shift in the retard direction from the second regulation phase can be regulated. Further, a part of the end surface of the first main regulation member 150 in the insertion direction X is positioned still closer to the retard side from the inner wall of the lock recess part 134 on the retard side as shown in FIG. 43, it is urged by the resilient force of the first main resilient member 170 in the insertion direction X but it is not inserted in the lock recess part 134 and is still inserted in the first regulation recess part 131.

Figure 45:
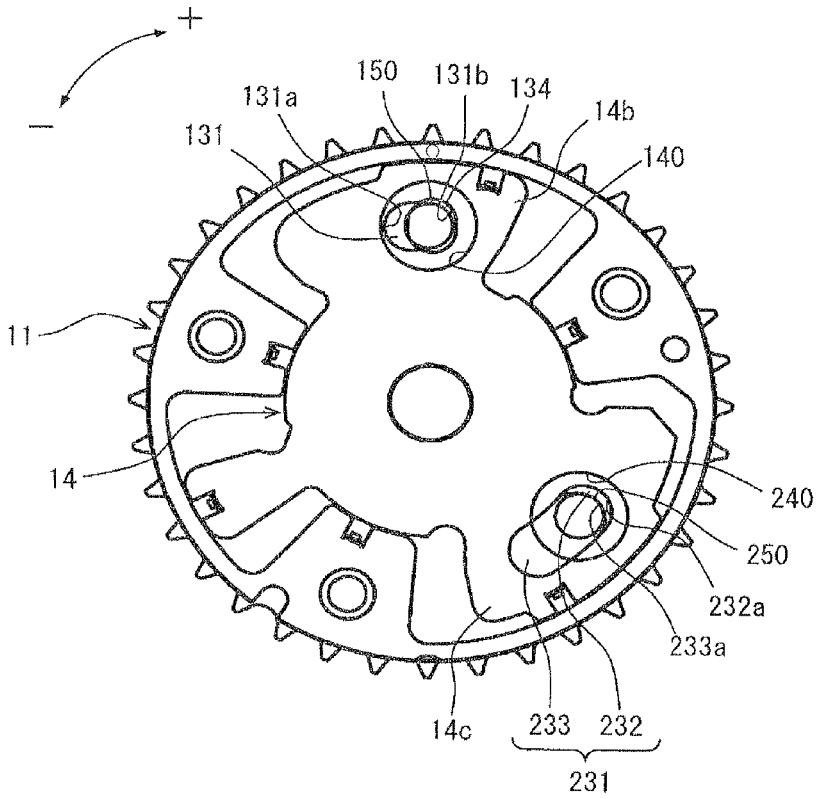
FIG. 45 is a plane view showing another operation state.
Figure 46:
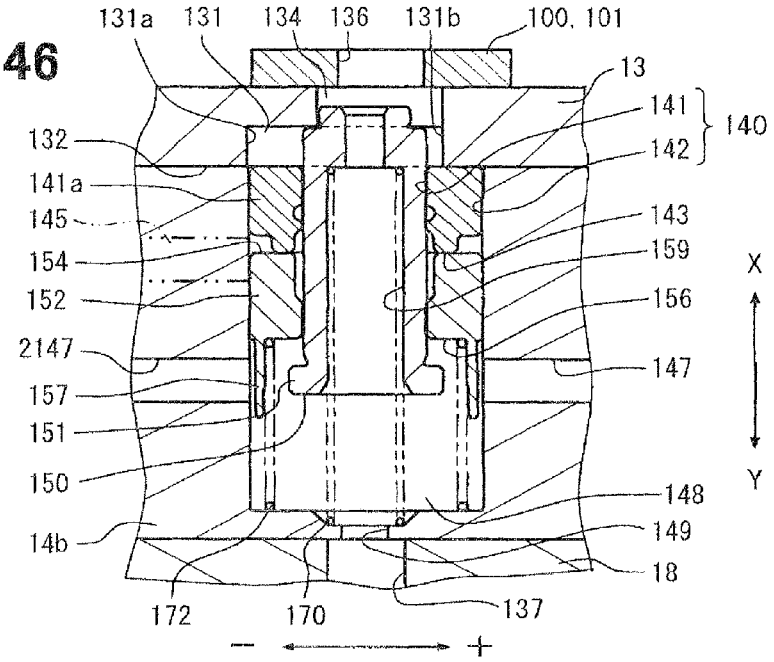
FIG. 46 is an enlarged cross-sectional view of the first regulation member shown in FIG. 45.
Figure 47:
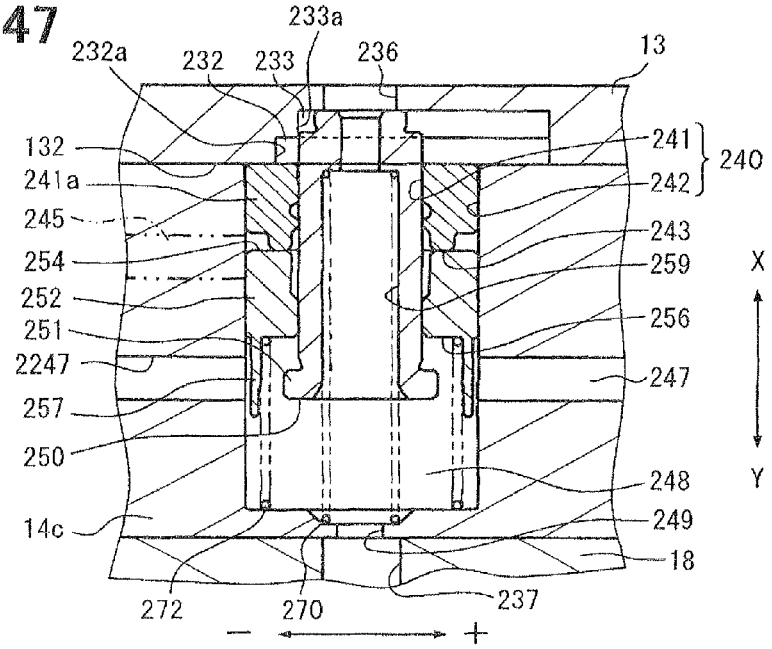
FIG. 47 is an enlarged cross-sectional view of the second regulation member shown in FIG. 45.

When the rotational phase comes to the third regulation phase which is the third position counted from the full retard phase in the advance direction as shown in FIG. 45 by the phase shift in the advance direction further from the second regulation phase, the end of the second main regulation member 250 in the insertion direction X is positioned on the advance side from the regulation stopper 233*a* as shown in FIG. 47. With this arrangement, the second main regulation member 250 moves in the insertion direction X with the second main restoring force of the second main resilient member 270 and is inserted in the deep bottom part 233 of the second regulation recess part 231. Accordingly, the phase shift in the retard direction from the third regulation phase can be regulated. At this time, as an outer peripheral member of the end of the first main regulation member 150 having a two-step shape in the insertion direction X is still positioned in the first regulation recess part 131 as shown in FIG. 46, the first main regulation member 150 is urged in the insertion direction X by the resilient force from the first main resilient member 170 but it is still inserted in the first regulation recess part 131.

Figure 33:
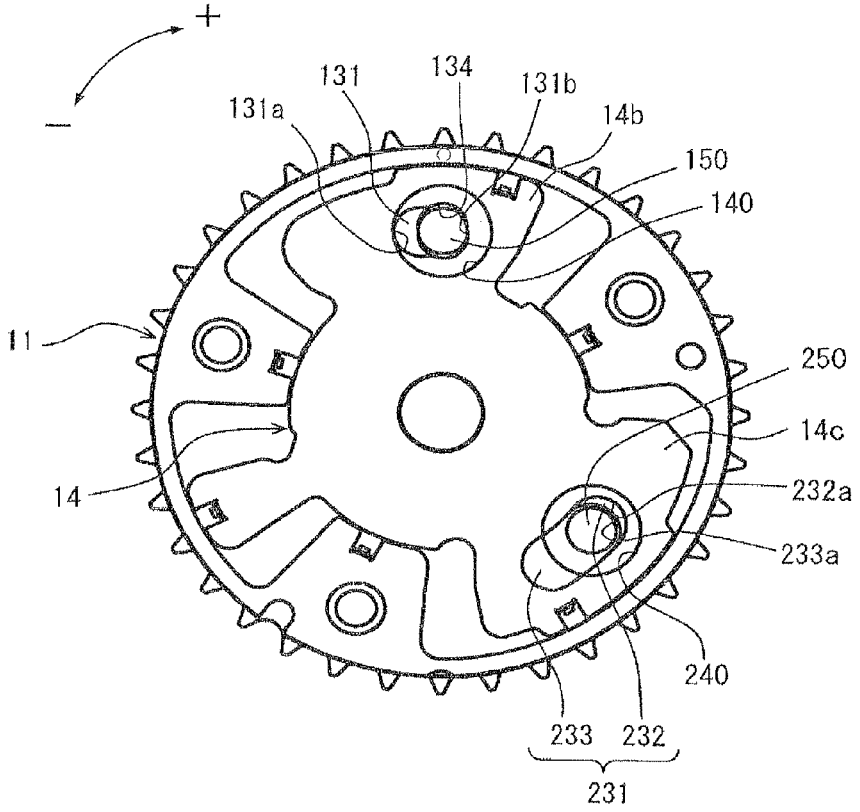
FIG. 33 is a plane view showing an arrangement of parts in the valve timing control apparatus in a fourth embodiment of the present invention.
Figure 34:
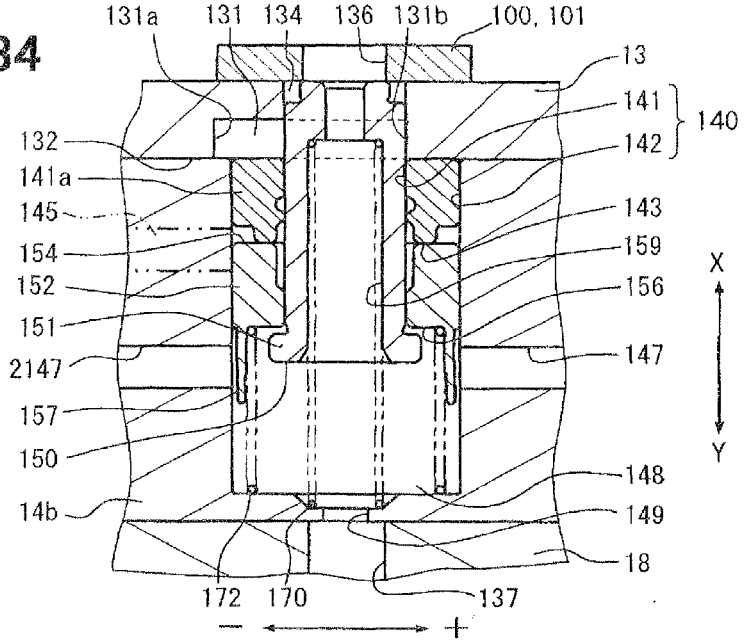
FIG. 34 is an enlarged cross-sectional view of a first regulation member shown in FIG. 33.
Figure 35:
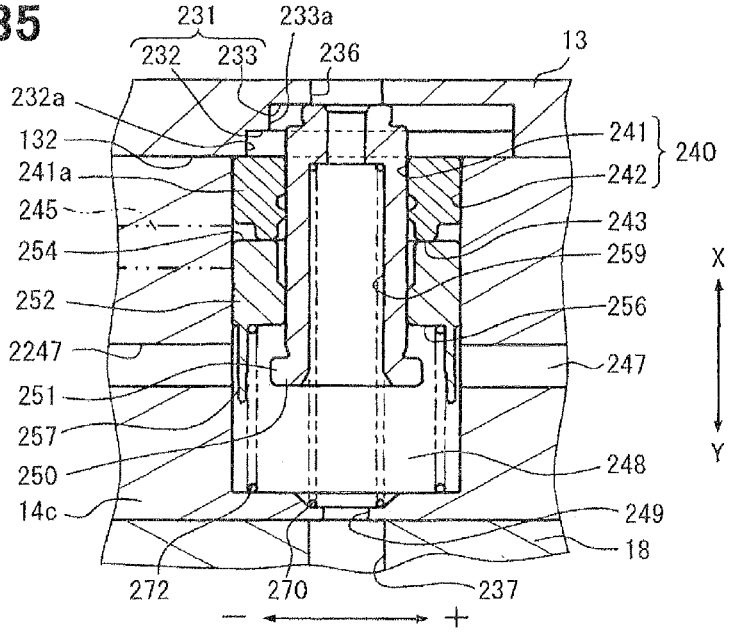
FIG. 35 is an enlarged cross-sectional view of a second regulation member shown in FIG. 33.

When the rotational phase comes to the lock phase as shown in FIG. 33 by phase shift further from the third regulation phase to the advance side, the first main regulation member 150 is stopped by the regulation stopper 131*b* at the advance end of the first regulation recess part 131 as shown in FIG. 34 and pressed against the regulation stopper 131*b* by the restoring force of the urging member 120 and urged by the first main restoring force of the first main resilient member 170, and is inserted in and engaged with the lock recess part 134 from the first regulation recess part 131 side. Accordingly, the rotational phase is regulated to the lock phase and locked. At this time, the second main regulation member 250 is still inserted in the first regulation recess part 131 as shown in FIG. 45.

Figure 48:
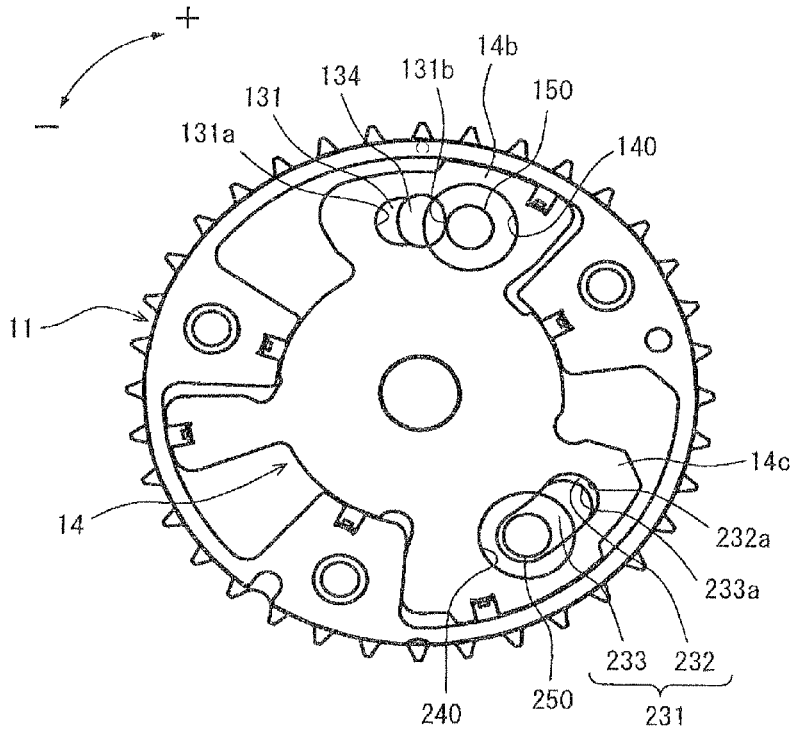
FIG. 48 is a plane view showing another operation state.
Figure 49:
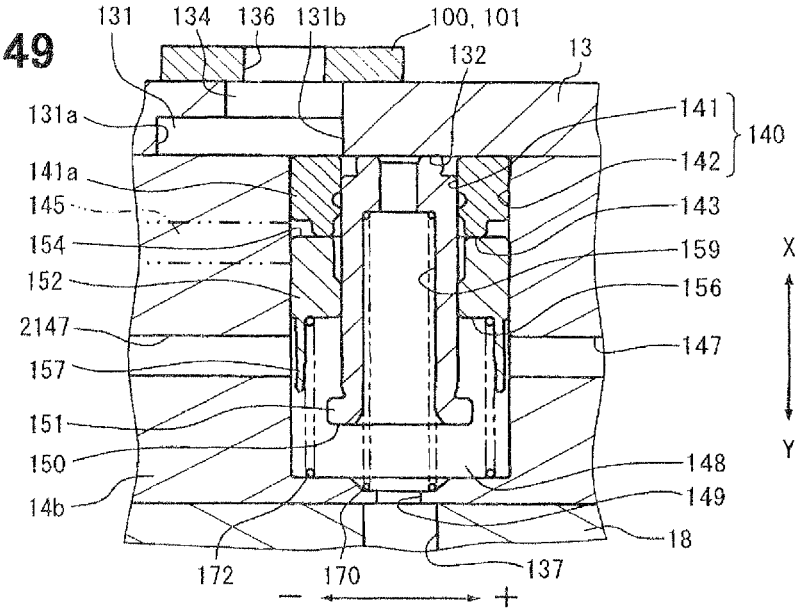
FIG. 49 is an enlarged cross-sectional view of the first regulation member shown in FIG. 48.
Figure 50:
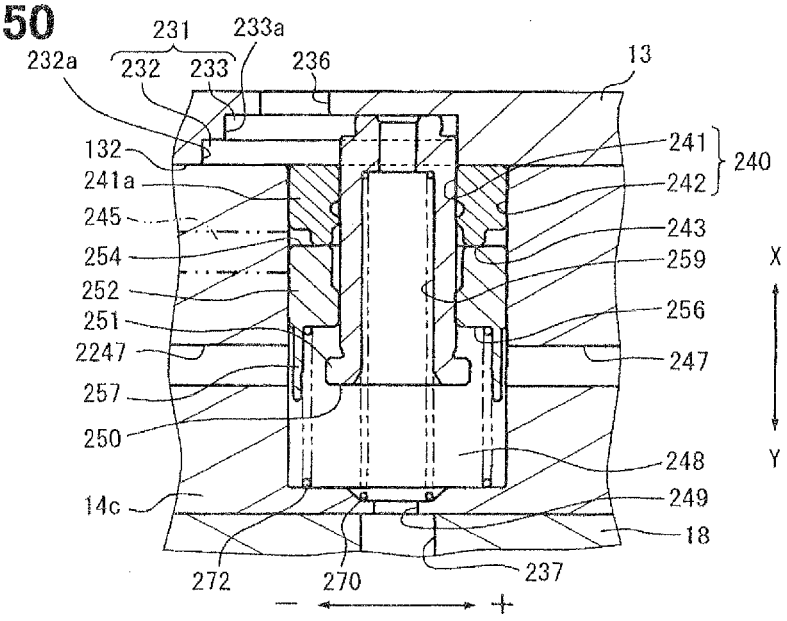
FIG. 50 is an enlarged cross-sectional view of the second regulation member shown in FIG. 48.

When the rotational phase is the full advance phase shown in FIG. 48, the end of the second main regulation member 250 in the insertion direction X is positioned on the retard side of the advance-side inner wall of the second regulation recess part 231 as shown in FIG. 50. With this arrangement, the second main regulation member 250 moves in the insertion direction X with the second main restoring force of the second main resilient member 270 and inserted in the deep bottom part 233 of the second regulation recess part 231. Also, as shown in FIG. 50, the end of the first main regulation member 150 in the insertion direction X is in a position in contact with the inner surface 132 of the cover member 13, which surface is formed on the advance side of the regulation stopper 131*b*. As a result, even when the first main regulation member 150 is urged in the insertion direction X by the resilient force from the first main resilient member 170, the first main regulation member 150 is not inserted into the first regulation recess part 131 recessed from the inner surface 132.

Next, the relation between the oil pressure of the oil in the operation chambers 146 and 246 and the behaviors of the first and second sub regulation members 151 and 252 and the like will be described with reference to FIGS. 51 to 54. FIGS. 51 to 54 are explanatory views of the first regulation structure. However, the operation state of the second regulation structure is the same as the operation state of the first regulation structure described below.

Figure 51:
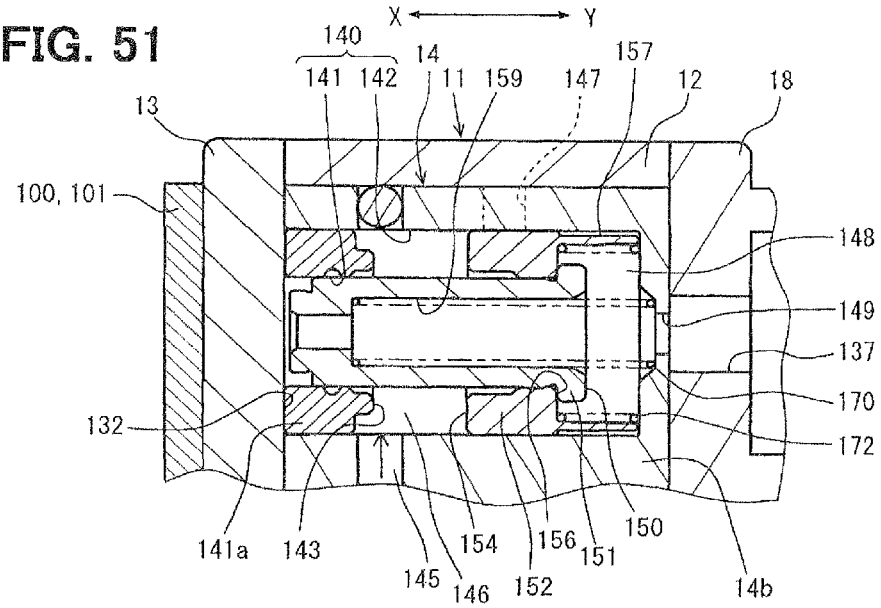
FIG. 51 is an enlarged cross-sectional view showing an operation state.

When the pressure-increased oil is introduced through the first regulation passage 145 to the operation chamber 146, the pressure in the operation chamber 146 is increased and the pressure reception part 154 is pushed in the escape direction Y as shown in FIG. 51. Accordingly, the first sub regulation member 152 slides on the outside of the first main regulation member 150 in the escape direction Y against the resilient force of the first sub resilient member 172. When the inflow of the oil into the operation chamber 146 and the movement of the first sub regulation member 152 in the escape direction Y progress, the engagement part 156 of the first sub regulation member 152 comes into contact with and engaged with the projection member 151 of the first main regulation member 150, and further, the first sub regulation member 152 and the first main regulation member 150 integrally move in the escape direction Y. With this arrangement, because the first main regulation member 150 moves in the escape direction Y, the first main regulation member 150 escapes from the first regulation recess part 131, and the phase is released from the regulation.

Figure 52:
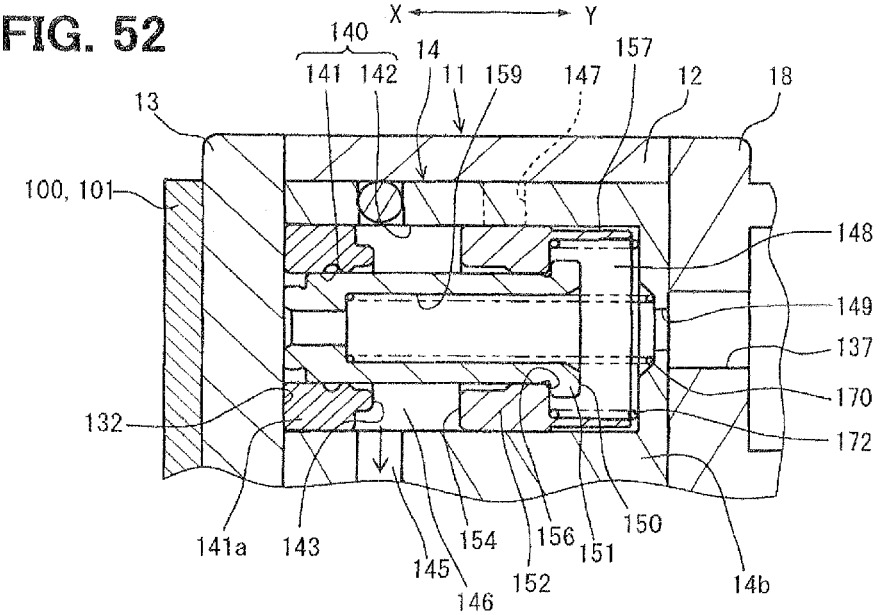
FIG. 52 is an enlarged cross-sectional view showing another operation state.
Figure 53:
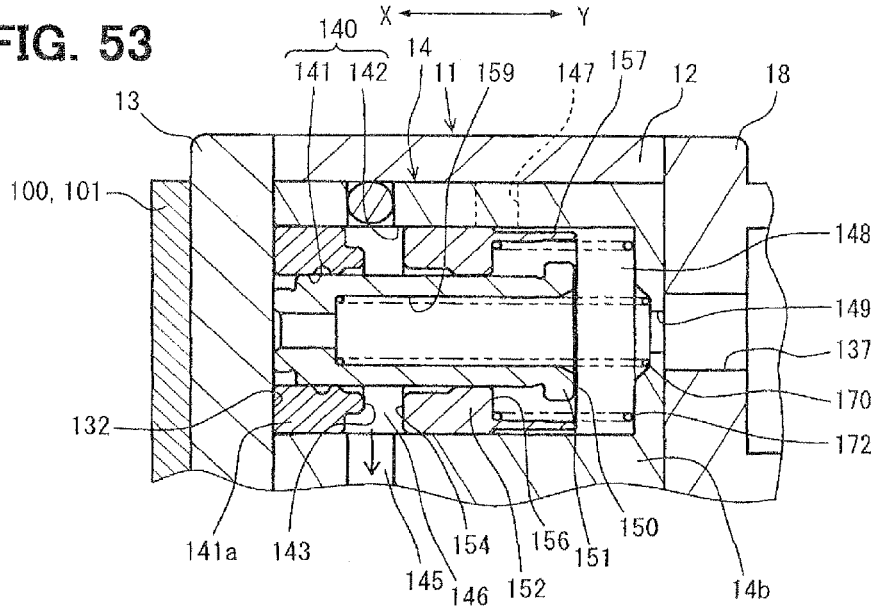
FIG. 53 is an enlarged cross-sectional view showing another operation state.
Figure 54:
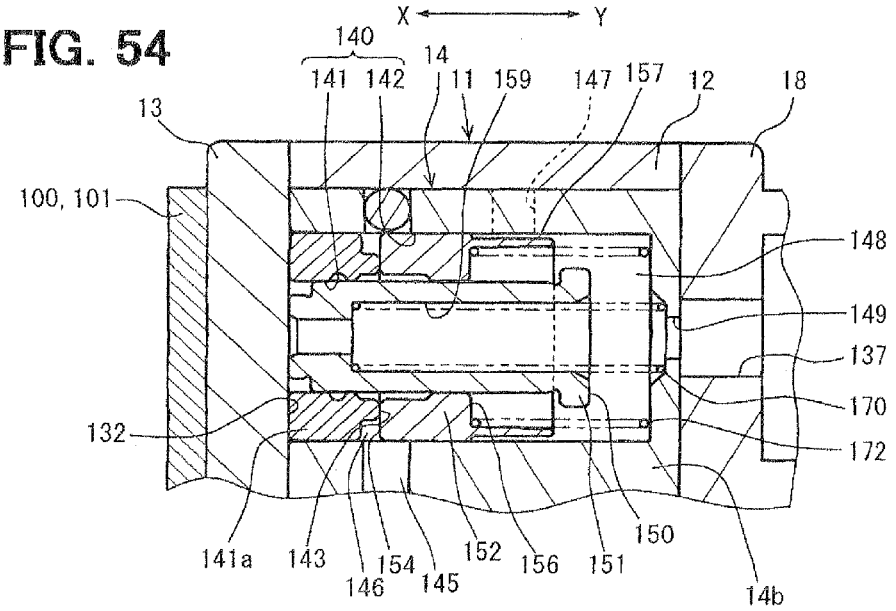
FIG. 54 is an enlarged cross-sectional view showing another operation state.

Next, when the oil pressure of the oil is reduced, the pressure pressing the pressure reception part 154 is reduced, and the resilient force of the first sub resilient member 172 exceeds the pressure, in contrast. Thus, the first sub resilient member 172 urges the first sub regulation member 152 in the insertion direction X back, as shown in FIG. 52. Accordingly, the oil is pushed out of the operation chamber 146 and begins to flow to the first regulation passage 145 by the movement of the first sub regulation member 152 in the insertion direction X, and the first main regulation member 150 moves in the insertion direction X into contact with the inner surface 132 of the cover member 13. In a state, where the first main regulation member 150 is in contact with the inner surface 132 of the cover member 13 and movement in the insertion direction X is regulated as shown in FIG. 52, the first sub regulation member 152 is urged by the resilient force of the first sub resilient member 172 and only the first sub regulation member 152 slides on the outside of the first main regulation member 150 in the insertion direction X, as shown in FIG. 53. Accordingly, the volume of the operation chamber 146 is reduced, the oil further flows to the first regulation passage 145, and discharge from the operation chamber 146 is promoted. Further, when the slide of only the first sub regulation member 152 in the insertion direction X progresses, the pressure reception part 154 of the first sub regulation member 152 strikes the end surface 143 of the sleeve 141*a* and the volume of the operation chamber 146 becomes minimum. Accordingly, the oil completely flows out of the operation chamber 146 and the oil discharge is completed.

Other Embodiment

As described above, the multiple embodiments of the present invention have been explained, however, the present invention is not to be interpreted within these embodiments but applicable to various embodiments within a range not departing from the spirit and scope of the invention.

More particularly, in the first to third embodiments, it may be arranged such that the set of the second regulation recess part 231, the second main regulation member 250, the second sub regulation members 252, 2252, 3252, the second main resilient member 270 and the second sub resilient member 272 is not provided.

Figure 30A:
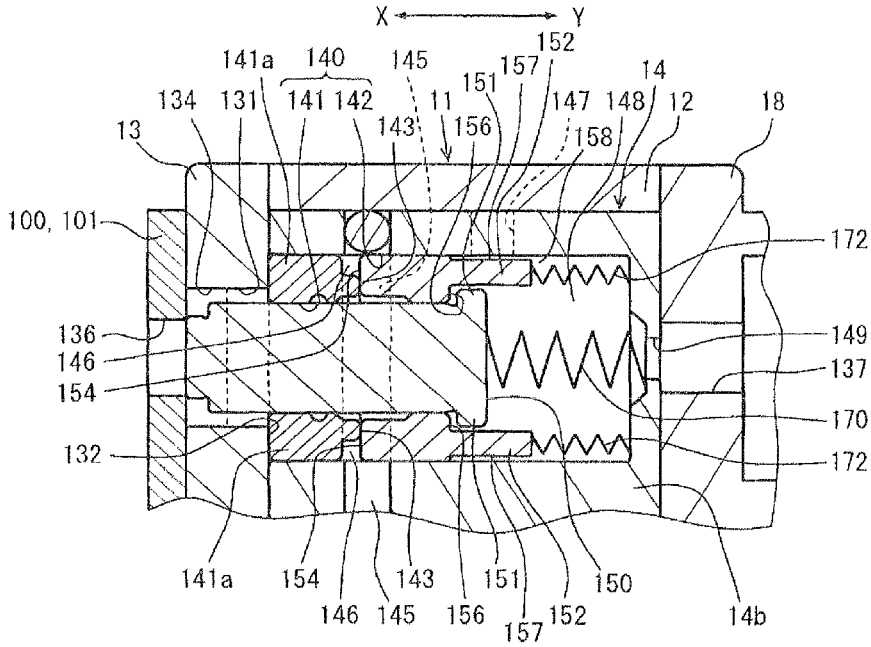
FIG. 30A is an enlarged cross-sectional view and FIG. 30B is an exploded perspective view of a modification of the first embodiment of the present invention.
Figure 30B:
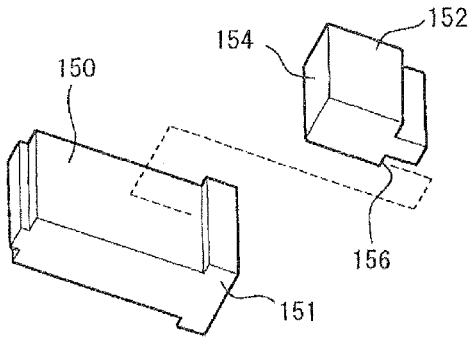

Further, in the first to third embodiments, as in a modification shown in FIGS. 30A and 30B, it may be arranged such that the main regulation members 150 and 250 and the sub regulation members 152, 252, 2152, 2252, 3152 and 3252 are formed in plate shape. FIGS. 30A and 30B show the modification of the pair of the regulation members 150 and 152. In this case, it is preferable that the pairs of sub regulation members 152, 252, 2152, 2252, 3152 and 3252, holding the main regulation members 150 and 250 between them, are provided as shown in FIG. 30A.

Figure 31:
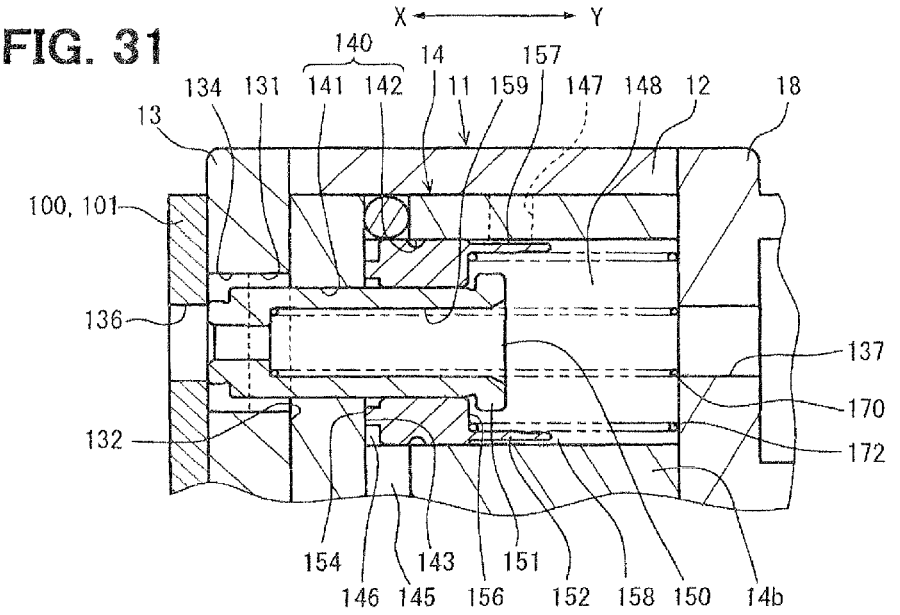
FIG. 31 is an enlarged cross-sectional view showing the modification of the first embodiment of the present invention.

Further, in the first to third embodiments, as in a modification shown in FIG. 31, it may be arranged such that the small diameter support parts 141 and 241 are formed with the main body of the vane rotor 14. FIG. 31 shows the modification of the small diameter support part 141.

Further, in the first to third embodiments, it may be arranged such that the set of the urging member 120, the housing groove 102 and the rotor groove 112 is not provided. In addition, it may be arranged such that the first to third embodiments, where the relation between the advance and the retard is reversed, are implemented.

Figure 32:
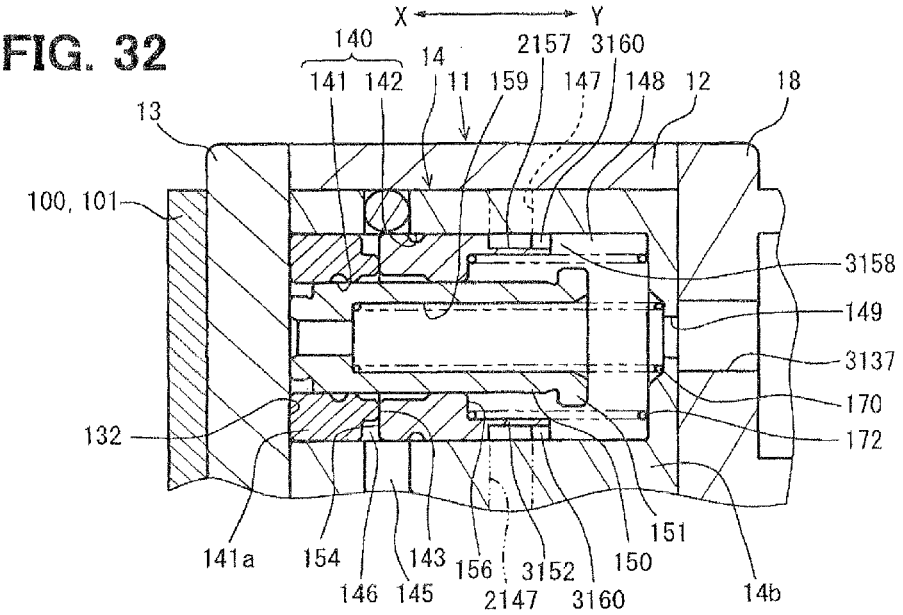
FIG. 32 is an enlarged cross-sectional view showing a modification of a third embodiment of the present invention.

Further, in addition, in the third embodiment, in the sub regulation members 3152 and 3252, the ventilation passages 3160 and 3260 are provided at the bottom of the peripheral grooves 2157 and 2257, however, similar operation can be obtained when the ventilation passages 3160 and 3260 are formed by opening the side portions of the peripheral grooves 2157 and 2257 at the ends of the sub regulation members 3152 and 3252 as in a modification shown in FIG. 32. FIG. 32 shows the modification of the sub regulation member 3152.

Figure 55:
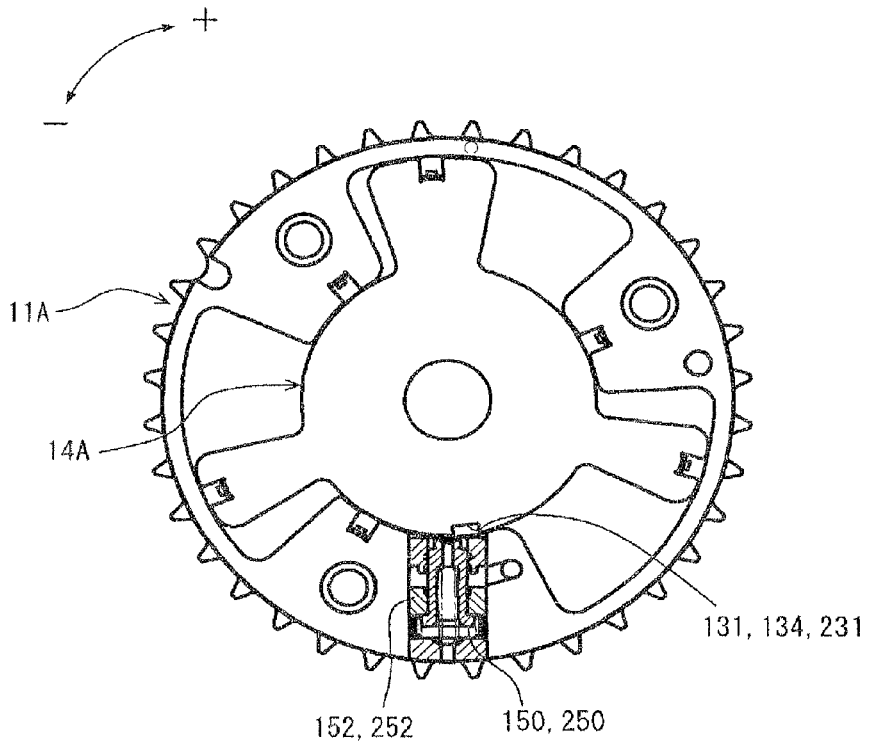
FIG. 55 is a cross-sectional view showing an arrangement of parts in a modification of the first to fourth embodiments of the present invention.

In the above-described first to fourth embodiments, the main regulation members 150 and 250 are provided on the vane rotor 14, and the regulation recess parts 131 and 231 and the lock recess part 134 are formed in the housing 11, however, the present invention is not limited to this arrangement. For example, as shown in FIG. 55, it may be arranged such that the main regulation members 150 and 250 and the sub regulation members 152 and 252 are provided in predetermined positions of a housing 11A, and the regulation recess parts 131 and 231 and the lock recess part 134 are formed in the vane rotor 14. Further, in the main regulation members 150 and 250 and the sub regulation members 152 and 252 in this case, the insertion direction X is radial inward direction with respect to a vane rotor 14A, and the escape direction Y is set as a radial outward direction. That is, the main regulation members 150 and 250 are reciprocally movably received in one of the vane rotors 14 and 14A and the housings 11 and 11A, and move in the insertion direction X to be inserted into the regulation recess part and the like formed in the other one of the vane rotors and the housings, to regulate the rotational phase at the regulation phase between the full advance phase and the full retard phase, and move in the escape direction Y to escape from the regulation recess part and the like to release the rotational phase from regulation. Further, the sub regulation members 152 and 252 are received reciprocally movably in the direction, which the main regulation members 150 and 250 are also movable, and have the pressure reception parts 154 and 254 to receive pressure in the escape direction X from the oil introduced to the operation chambers 146 and 246 formed in the one of the vane rotors 14 and 14A and the housings 11 and 11A, and the engagement parts 156 and 256 engaged with the main regulation members 150 and 250 in the escape direction Y and away in the insertion direction Y.

Further, the present invention is applicable to an apparatus to control valve timing of an exhaust valve as a "drive gear" and an apparatus to control valve timings of both intake valve and exhaust valve other than the apparatus to control valve timing of an intake valve.

What is claimed is:

1. A valve timing control apparatus applied to an internal combustion engine, in which a camshaft opens and closes a drive gear by torque transmission from a crankshaft, the valve timing control apparatus controlling valve timing of the drive gear with hydraulic fluid supplied from a supply source in accordance with rotation of the internal combustion engine, the valve timing control apparatus comprising:

a housing configured to rotate in synchronization with the crankshaft;

a vane rotor that is configured to rotate in synchronization with the camshaft and has a vanes to define an advance chamber and a retard chamber arranged in a rotational direction in an interior space of the housing, the vane rotor changing a rotational phase to an advance side or a retard side with respect to the housing by introduction of hydraulic fluid to the advance chamber or the retard chamber; and a regulation member reciprocally movably received in one of the vane rotor and the housing, the regulation member moving in an insertion direction to be inserted into a recess part formed at the other one of the vane rotor and the housing to regulate the rotational phase at a regulation phase between a full advance phase and a full retard phase, the regulation member moving in an escape direction to escape out of the recess part to release the rotational phase from regulation, wherein:

the housing forms an opening hole opened to atmosphere;

the vane rotor forms:

an advance communication hole that communicates with the advance chamber; and a retard communication hole that communicates with the retard chamber; and a predetermined member moves from an interruption position at which communication between the advance communication hole and the retard communication hole is prohibited, to communicate the opening hole with a space formed between the advance communication hole and the retard communication hole.

2. The valve timing control apparatus according to claim 1, further comprising:

a communication passage that is formed from the opening hole to the advance communication hole and the retard communication hole when the predetermined member moves from the interruption position; and a throttle member provided in the communication passage to reduce a flow area of fluid.

3. The valve timing control apparatus according to claim 2, further comprising a sub regulation member as the predetermined member reciprocally movably received in the one of the vane rotor and the housing, the sub regulation member being also movable in the directions, in which a main regulation member as the regulation member is movable, the sub regulation member having:

the throttle member;

a pressure reception part to receive pressure, which is applied in the escape direction from hydraulic fluid introduced to an operation chamber formed in the one of the vane rotor and the housing; and an engagement part engageable with the main regulation member in the escape direction and disengageable from the main regulation member in the insertion direction, wherein the sub regulation member moves in the insertion direction in accordance with a reduction of pressure of hydraulic fluid introduced to the operation chamber, to communicate the opening hole with a space formed between the advance communication hole and the retard communication hole.

* * * * *